United States Patent [19]

Nakazyo et al.

[11] Patent Number: 4,900,655

[45] Date of Patent: Feb. 13, 1990

[54] SILVER HALIDE COLOR PHOTOGRAPHIC LIGHT-SENSITIVE MATERIAL

[75] Inventors: Kiyoshi Nakazyo; Takeshi Hirose; Genichi Hurusawa; Osamu Takahashi; Nobuo Furutachi; Hidetoshi Kobayashi, all of Ashigara, Japan

[73] Assignee: Fuji Photo Film Co., Ltd., Kanagawa, Japan

[21] Appl. No.: 125,796

[22] Filed: Nov. 27, 1987

Related U.S. Application Data

[63] Continuation-in-part of Ser. No. 865,694, May 22, 1986, abandoned.

[30] Foreign Application Priority Data

May 22, 1985 [JP] Japan ..... 60-110044
Oct. 11, 1985 [JP] Japan ..... 60-226374

[51] Int. Cl.[4] ..... G03C 7/38

[52] U.S. Cl. ..... 430/546; 430/548; 430/558

[58] Field of Search ..... 430/558, 546, 548

[56] References Cited

U.S. PATENT DOCUMENTS

| | | | |
|---|---|---|---|
| 2,322,027 | 6/1943 | Jelley et al. | 430/546 |
| 4,500,630 | 2/1985 | Sato et al. | 430/386 |
| 4,540,654 | 9/1985 | Sato et al. | 430/381 |
| 4,590,153 | 5/1986 | Kawagishi et al. | 430/558 |
| 4,659,652 | 4/1987 | Kawagishi et al. | 430/558 |
| 4,675,275 | 6/1987 | Nishijima et al. | 430/551 |
| 4,741,995 | 5/1988 | Tani et al. | 430/558 |
| 4,774,172 | 9/1988 | Kawagishi et al. | 430/558 |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A silver halide color photographic light-sensitive material comprising a support having provided thereon at least one silver halide emulsion layer, wherein at least one magenta coupler represented by the formula (VIII)

where the groups in the formula are defined in the specification; is dispersed in the silver halide emulsion layer in the presence of at least one high-boiling organic solvent represented by one of the formulae (II), (III), (IV) and (V):

$R^3—COOR^4$ (II)

(III)

(IV)

$R^3—O—R^4$, (V)

where the groups in the formulae are described in the specification. The a high boiling point organic solvent has a dielectric constant of not less than 4.00 at 25° C. and 10 KHz.

7 Claims, No Drawings

SILVER HALIDE COLOR PHOTOGRAPHIC LIGHT-SENSITIVE MATERIAL

This is a continuation-in-part of application Ser. No. 865,694 filed May 22, 1986, now abandoned.

FIELD OF THE INVENTION

This invention relates to a silver halide color photographic material and, more particularly, to a silver halide color photographic material having improved development activity and color reproducibility which is capable of forming a color image having fastness.

BACKGROUND OF THE INVENTION

A widely employed system for silver halide color photographic materials uses a light-sensitive silver halide emulsion and a so-called dye-forming coupler capable of forming a dye upon reacting with an oxidized product of an aromatic primary amine developing agent (hereinafter simply referred to as "coupler"). In particular, a combination of a yellow coupler, a cyan coupler and a magenta coupler is usually employed in color photographic light-sensitive materials. Among these couplers, pyrazoloazole couplers have recently been developed as magenta couplers.

Differing from the conventional 5-pyrazolone magenta couplers, the pyrazoloazole couplers have favorable characteristics in that they do not show side absorption in the vicinity of 430 nm; their absorption in the longer wavelength side sharply decreases to zero; they form magenta dyes having high color purity; the dye images obtained are excellent in light-fastness; and the like.

However, if the pyrazoloazole magenta coupler is dispersed in a silver halide emulsion layer using a conventionally employed high-boiling organic solvent, the resulting light-sensitive material, when exposed and developed, produces an inferior dye image to that produced by the conventional 5-pyrazolone couplers in terms of sensitivity, gradation and maximum density. Thus, there arise serious problems in putting pyrazoloazole couplers to practical use.

A color development solution contains an aromatic primary amine as a color development agent, which is much more subject to air oxidation under higher pH condition, thereby resulting in reducing an amount thereof to lower the development activity.

To prohibit such a drawback, a so-called preservative such as sulfites (e.g., sodium sulfite, etc.), bisulfites (e.g., potassium bisulfite, etc.), hydroxylamine and triethanolamine are added. However, when the sulfites are used as a preservative, an amount of the sulfite per unit volume of the agent may be varied depending on a contact with an air or an amount of the photosensitive material to be treated.

Furthermore, it is known that the sulfites react with an oxidation product of the aromatic primary amine development agent, i.e., quinone di-imine, to form addition product of the sulfites, thereby impairing a development activity. That is to say, the quinone di-imine which is formed by subjecting oxidation to the development agent by AgX, is competitively reacted by a coupling reaction with a coupler and an addition reaction with a sulfites at the same time. In the case of a coupler having lower coupling activity, a color development is suffered from a concentration of the sulfites to vary the photographical characteristics.

SUMMARY OF THE INVENTION

An object of this invention is to provide a silver halide color photographic material having improved development activity, in which a pyrazoloazole magenta coupler and a high-boiling organic solvent are used.

Another object of this invention is to provide a silver halide color photographic material using a pyrazoloazole magenta coupler, whose absorption in a longer wavelength side sharply descends to zero, which forms a magenta dye image excellent in hue, and which exhibits improved color reproducibility.

A further object of this invention is to provide a silver halide color photographic material using a pyrazoloazole coupler, which forms a dye image having improved fastness.

A still further object of this invention is to provide a silver halide color photographic material which forms a dye image having improved sensitivity, gradation and maximum density.

A still another object of this invention is to provide a silver halide color photographic material having a little photographical change depending on a variety of additive agents in the treating solution.

As a result of extensive investigations directed to achieving the above-described objectives, it has been unexpectedly found that the aforesaid problems associated with the pyrazoloazole magenta couplers can be overcome by dispersing them in specific high-boiling solvents having a dielectric constant of not less than 4.00 (25° C., 10 KHz). This invention has been completed based on this finding.

The present invention is directed to a silver halide color photographic material comprising a support having provided thereon at least one silver halide emulsion layer, wherein at least one magenta coupler represented by the following formula (VIII):

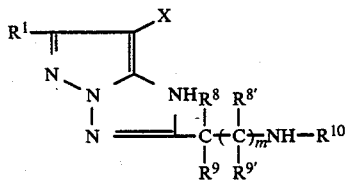

(VIII)

wherein $R^1$ represents a hydrogen atom, a halogen atom, a substituted or unsubstituted alkyl group, a substituted or unsubstituted aryl group, a substituted or unsubstituted heterocyclic group, a cyano group, a substituted or unsubstituted alkoxy group, a substituted or unsubstituted aryloxy group, a substituted or unsubstituted heterocyclic oxy group, a substituted or unsubstituted acyloxy group, a substituted or unsubstituted carbamoyloxy group, a substituted or unsubstituted silyloxy group, a substituted or unsubstituted sulfonyloxy group, a substituted or unsubstituted acylamino group, a substituted or unsubstituted anilino group, a substituted or unsubstituted ureido group, a substituted or unsubstituted imido group, a substituted or unsubstituted sulfamoylamino group, a substituted or unsubstituted carbamoylamino group, a substituted or unsubstituted alkylthio group, a substituted or unsubstituted arylthio group, a substituted or unsubstituted heterocyclic thio group, a substituted or unsubstituted alkoxycarbonylamino group, a substituted or unsubstituted aryloxycarbonylamino group, a substituted or substituted sulfonamido group, a substituted or unsubstituted carbamoyl group, a substituted or unsubstituted acyl group, a substituted or unsubstituted sulfamoyl group, a substituted or unsubstituted sylfonyl group, a substituted or unsubstituted sulfinyl group, a substituted or unsubstituted alkoxycarbonyl group or a substituted or unsubstituted arylkoxycarbonyl group; and x represents a hydrogen atom or a group releasable by coupling with an oxidized product of an aromatic primary amine developing agent, $R^8$, $R^{8'}$, $R^9$ and $R^{9'}$ each represents a hydrogen atom, a cyano group, a halogen atom, a substituted or unsubstituted alkyl group, a substituted or unsubstituted aryl group, a substituted or unsubstituted heterocyclic group, a substituted or unsubstituted alkoxy group; a substituted or unsubstituted aryloxy group, a substituted or unsubstituted acylamino group, a substituted or unsubstituted alkylthio group, a substituted or unsubstituted arylthio group, a substituted or unsubstituted sulfonamido group, a substituted or substituted carbamoyl group, a substituted or unsubstituted sulfamoyl group or a substituted or unsubstituted sulfonyl group, with proviso that $R^8$, $R^{8'}$, $R^9$ and $R^{9'}$ do not simultaneously take the same atom or group unless otherwise represents the hydrogen atom, the cyano group, the halogen atom and the substituted or unsubstituted alkyl group; M represents 0 or an integer of from 1 to 5; and $R^{10}$ represents a substituted or unsubstituted acyl group, a substituted or unsubstituted sulfonyl group, a substituted or unsubstituted alkoxycarbonyl group, a substituted or unsubstituted carbamoyl group or a substituted or unsubstituted sulfamoyl group; is dispersed in the silver halide emulsion layer in the presence of at least one high-boiling organic solvent represented by one of the following formulae (II), (III), (IV) and (V):

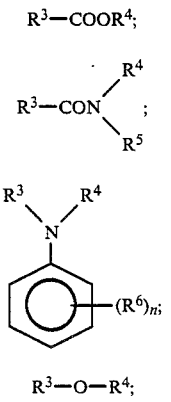

$$R^3—COOR^4; \quad (II)$$

$$R^3—CON(R^4)(R^5); \quad (III)$$

$$R^3R^4N—C_6H_4—(R^6)_n; \quad (IV)$$

$$R^3—O—R^4; \quad (V)$$

wherein $R^3$, $R^4$ and $R^5$ each represents a substituted or substituted alkyl group, a substituted or unsubstituted cycloalkyl group, a substituted or unsubstituted alkenyl group, a substituted or unsubstituted aryl group or a substituted or unsubstituted heterocyclic group; $R^6$ represents $R^3$, —$OR^3$ or —$SR^3$ is as defined above; and n represents an integer of from 1 to 5; when n is 2 or more each $R^6$ may be the same or different; $R^3$ and $R^4$ in the formula (V) may together form an oxirane ring, an oxorane ring or an oxane ring, which may be substituted or form a fused ring; and the high boiling point organic solvent has a dielectric constant of not less than 4.0 at 25° C. and 10 KHz.

DETAILED DESCRIPTION OF THE INVENTION

The compounds represented by the formula (VIII) include dimers or higher polymers formed at the positions where $R^1$, $R^{10}$ and/or X bond to formula (VIII) Z. The term "dimers or higher polymers" as herein used means compounds containing two or more moieties represented by the formula (VIII) per molecule and covers biscompounds and polymers couplers. The polymer couplers herein referred to include homopolymers derived solely from a monomer having the moiety represented by the formula (VIII), preferably the one having an ethylenically unsaturated group (hereinafter referred to as a vinyl monomer), and copolymers derived from the aforesaid monomer and a non-color-forming ethylenical monomer which does not undergo coupling with an oxidized product of an aromatic primary amine development agent.

The preferred heterocyclic groups stated in the present specification are 5-, 6-, or 7-membered saturated or unsaturated heterocyclic groups with at least one atom selected from N, S, and O. $R^1$ each represents a hydrogen atom, a halogen atom, a substitued or unsubstituted alkyl group, a substituted or unsubstituted aryl group, a substituted or unsubstituted heterocyclic group, a cyano group, a substituted or unsubstituted alkoxy group, a substituted or unsubstituted aryloxy group, a substituted or unsubstituted heterocyclic oxy group, a substituted or unsubstituted acyloxy group, a substituted or unsubstituted carbamoyloxy group, a substituted or unsubstituted silyloxy group, a substituted or unsubstituted sulfonyloxy group, a substituted or unsubstituted acylamino group, a substituted or unsubstituted anilino group, a substituted or unsubstituted ureido group, a substituted or unsubstituted imido group, a substituted or unsubstituted sulfamoylamino group, a substituted or unsubstituted carbamoylamino group, a substituted or unsubstituted alkylthio group, a substituted or unsubstituted arylthio group, a substituted or unsubstituted heterocyclic thio group, a substituted or unsubstituted alkoxycarbonylamino group, a substituted or unsubstituted aryloxycarbonylamino group, a substituted or unsubstituted sulfonamido group, a substituted or unsubstituted carbamoyl group, a substituted or unsubstituted acyl group, a substituted or unsubstituted sulfamoyl group, a substituted or unsubstituted sulfonl group, a substituted or unsubstituted sulfinyl group, a substituted or unsubstituted alkoxycarbonyl group or a substituted or unsubstituted aryloxycarbonyl group; and X is as defined above.

The substituents for the above groups include a halogen atom, an alkoxy group, an aryloxy group, an aryl group, a sulfonyl group, a sulfonamido group, a carbamoyl group, a sulfamoyl group, an alkylthio group, an arylthio group, an amido group, an alkoxycarbonyl group, an acyl group, a carboxyl group, an alkyl group, etc.

Examples of X include a hydrogen atom, a halogen atom, a carboxyl group and a group which is bonded to the carbon atom at the coupling position via an oxygen atom, a nitrogen atom or a sulfur atom.

The compounds represented by the formula (VIII) include bis-compounds, $R^1$, $R^{10}$ or X being a divalent linking group. In the polymer couplers derived from a vinyl monomer containing the moiety represented by the formula (VIII), $R^1$, or $R^{10}$ represents a mere bond or a divalent linking group, via which the moiety (VIII) is bonded to an ethylenically unsaturated group.

Specific examples of $R^1$, are a hydrogen atom, a halogen atom (e.g., a chlorine atom, a bromine atom, etc.), an alkyl group (e.g., a methyl group, a propyl group, a t-butyl group, a trifluoromethyl group, a tridecyl group, a 3-(2,4-di-t-amylphenoxy)propyl group, a 2-dodecyloxyethyl group, a 3-phenoxypropyl group, a 2-hexylsulfonylethyl group, a cyclopentyl group, a benzyl group, a group represented by the formula:

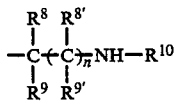

the definition of the symbols being hereinafter given, etc.), an aryl group (e.g., a phenyl group, a 4-t-butylphenyl group, a 2,4-di-t-amylphenyl group, a 4-tetradecaneamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., dodecylsulfonyloxy group, etc.), an acylamino group (e.g., an acetamido group, a benzamido group, a tetradecaneamido group, an α-(2,4-di-t-amylphenoxy)butylamido group, a γ-(3-t-butyl-4-hydroxyphenoxy)butyl-amido group, an α-[4-(4-hydroxyphenylsulfonyl)phenoxy]decaneamido group, etc.), an anilino group (e.g., a phenylamino group, a 2-chloroanilino group, a 2-chloro-5-tetradecaneamidoanilino group, a 2-chloro-5-dodecyloxycarbonylanilino group, an N-acetylanilino group, a 2-chloro-5-[α-(3-t-butyl-4-hydroxyphenoxy)-dodecaneamido]anilino group, etc.), an ureido group (e.g., a phenylureido group, a methylureido group, an N,N-dibutylureido group, etc.), an imodo group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecaneamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-t-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-t-amylphenoxy)propyl]carbamoyl group, etc.), an acyl group (e.g., an acetyl group, a (2,4-di-t-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, a 3-pentadecyloxycarbonyl group, an octadecyloxycarbonyl group, etc.) and an aryloxycarbonyl group (e.g., a phenyloxycarbonyl group, etc.).

Typical examples of the coupling-releasable group as represented by X include a halogen atom (e.g., a chlorine atom, a bromine atom, an iodine atom, etc.), a carboxyl group, a releasable group bonded via an oxygen atom (e.g., an acetoxy group, a propanoyl oxy group, a benzoyloxy group, a 2,4-dichlorobenzoyloxy group, an ethoxyoxaloyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a benzothiazolyloxy group, etc.), a releasable group bonded via a nitrogen atom (e.g., a benzenesulfonamido group, an N-ethyltoluenesulfonamido group, a heptafluorobutaneamido group, a 2,3,4,5,6-pentafluorobenzamido group, an octanesulfonamido group, a p-cyanophenylureido group, an N,N-diethylsulfamoylamino group, a 1-piperidyl group, a 5,5-diethyl-2,4-dioxo-3-oxazolidinyl group, a 1-benzylethoxy-3-hydantoinyl group, a 2N-1,1-dioxo-3(2H)-oxo-1,2-benzoisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.), a releasable group bonded via a sulfur atom (e.g., a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-t-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolythio group, a 2-dodecylthio-5-thiophenylthio group, a 2-phenyl-3-dodecyl-1,2,4-triazolyl-5-thio group, etc.), and the like.

In the case where $R^1$, $R^{10}$ or X is a divalent group to form a bis-compound, such a divalent group includes a substituted or unsubstituted alkylene group (e.g., a methylene group, an ethylene group, a 1-10-decylene group —$CH_2CH_2$—O—$CH_2CH_2$—, etc.), a substituted or unsubstituted phenylene group (e.g., a 1,4-phenylene group, a 1,3-phenylene group,

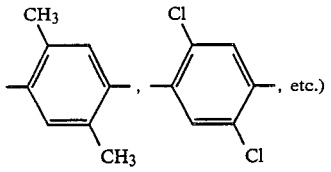

—NHCO—$R_2$—CONH—, wherein $R_2$ represents a substituted or unsubstituted alkylene or phenylene group, and the like.

In the cases where the compounds represented by the formula (VIII) are vinyl monomers which form polymer couplers, the linking group represented by $R^1$, $R^{10}$ includes a substituted or unsubstituted alkylene group (e.g., a methylene group, an ethylene group, a 1,10-decylene group, —$CH_2CH_2OCH_2CH_2$—, etc.), a substituted or unsubstituted phenylene group (e.g., a 1,4-phenylene group, a 1,3-phenylene group,

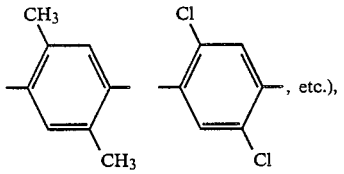

—NHCO—, —CONH—, —O—, —OCO—, a substituted or unsubstituted aralkylene group (e.g.,

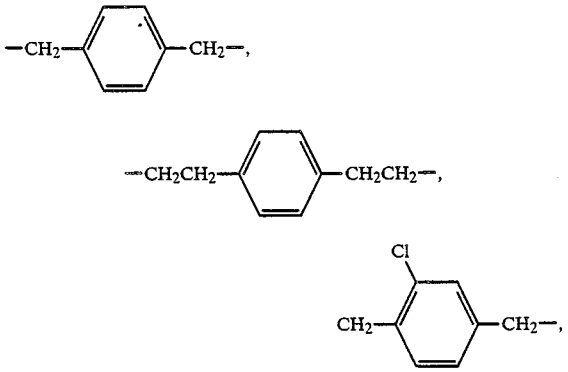

and combinations thereof.

The ethylenically unsaturated group in the vinyl monomer may contain a substituent other than a hydrogen atom on the ethylenical carbon atom thereof. Preferred substituents include a hydrogen atom, a chlorine atom and a lower alkyl group having from 1 to 4 carbon atoms.

The polymer couplers according to the present invention are homopolymers or copolymers obtained by polymerizing the above-described vinyl monomer or monomers and, if necessary, a non-color-forming vinyl monomer or monomers.

The non-color-forming vinyl monomers which do not undergo coupling with an oxidized product of an aromatic primary amine developing agent can arbitrarily be selected from compounds copolymerizable with the vinyl monomers containing a color-forming precursor according to the present invention, including acrylic acid, α-chloroacrylic acid, an α-alacrylic acid (e.g., methacrylic acid) and esters or amides derived from these acrylic acids (e.g., acrylamide, n-butylacrylamide, t-butylacrylamide, diacetonacrylamide, methylenebisacrylamide, methacrylamide, methyl acrylate, ethyl acrylate, n-propyl acrylate, n-butyl acrylate,t-butyl acrylate, iso-butyl acrylate, 2-ethylhexyl acrylate, n-octyl acrylate, lauryl acrylate, methyl methacrylate, ethyl methacrylate, n-butyl methacrylate, β-hydroxyethylmethacrylates, etc.), vinyl esters (e.g., vinyl acetate, vinyl propionate and vinyl laurate), acrylonitrile, methacrylonitrile, aromatic vinyl compounds (e.g., styrene and its derivatives, vinyltoluene, divinylbenzene, vinylacetophenone and sulfostyrene), itaconic acid, citraconic acid, crotonic acid, vinylidene chloride, vinyl alkyl ethers (e.g., vinyl ethyl ether), maleic acid, maleic anhydride, maleic esters, N-vinyl-2-pyrrolidone, N-vinylpyridine, 2- or 4-vinylpyridine, etc. These non-color-forming ethylenically unsaturated monomers may be used in combinations of two or more thereof.

The following discussion is offered on formula (VIII):

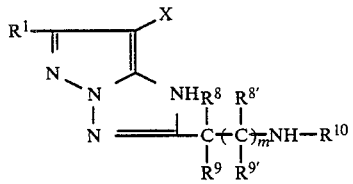

(VIII)

wherein $R^1$ and X are as defined above; $R^8$, $R^{8'}$, $R^9$ and $R^{9'}$ each represents a hydrogen atom, a cyano group, a halogen atom, a substituted or unsubstituted alkyl group, a substituted or unsubstituted aryl group, a substituted or unsubstituted heterocyclic group, a substituted or unsubstituted alkoxy group, a substituted or unsubstituted aryloxy group, a substituted or unsubstituted acylamino group, a substituted or unsubstituted alkylthio group, a substituted or unsubstituted arylthio group, a substituted or unsubstituted sulfonamido group, a substituted or unsubstituted carbamoyl group, a substituted or unsubstituted sulfamoyl group or a substituted or unsubstituted sulfonyl group, with the proviso that $R^8$, $R^{8'}$, $R^9$ and $R^{9'}$ do not simultaneously take the same atom or group unless otherwise represent the hydrogen atom, the cyano group, the halogen atom and the substituted or unsubstituted alkyl group; m represents 9 or an integer of from 1 to 5; and $R^{10}$ represents a substituted or unsubstituted acyl group, a substituted or unsubstituted sulfonyl group, a substituted or unsubstituted alkoxycarbonyl group, a substituted or unsubstituted carbamoyl group or a substituted or unsubstituted sulfamoyl group.

In the formula (VIII), the heterocyclic group for $R^8$, $R^{8'}$, $R^9$ and $R^{9'}$ preferably is 2-pyridyl, 2-thienyl, 2-pyrazolyl or 4-pyrazolyl, the acyl group for $R^{10}$ preferably is a substituted or unsubstituted alkylcarbonyl group, and the sulfonyl group for $R^{10}$ preferably is an arylsulfonyl group.

The couplers of formula (VIII) can be synthesized by the processes described in European Pat. No. 119860A and Japanese patent application (OPI) Nos. 172982/85, 190779/85, 197688/85 and 215687/85, etc. Specific Examples of these couplers are given in the above-recited publications, respectively.
The following formula (VI) and (VII) are generic to formula (VIII) of the present invention:
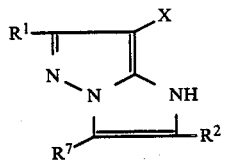
(VI)
-continued
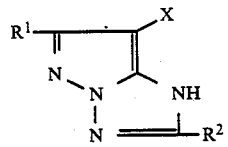
(VII)
$R^2$ and $R^7$ have the same meaning as $R^1$ in formula (VIII); X has the same meaning as X in formula (VIII). Examples of various couplers are given below.
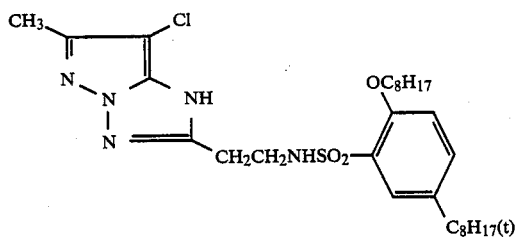
(M-1)
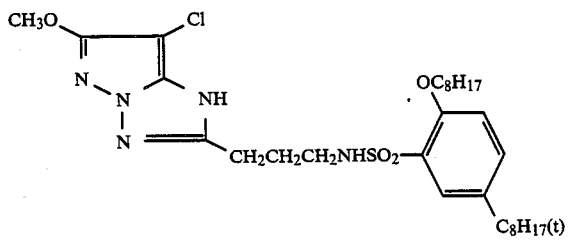
(M-2)
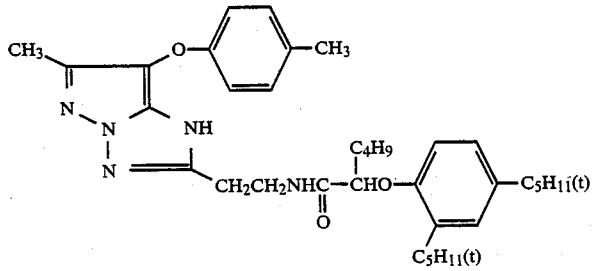
(M-3)
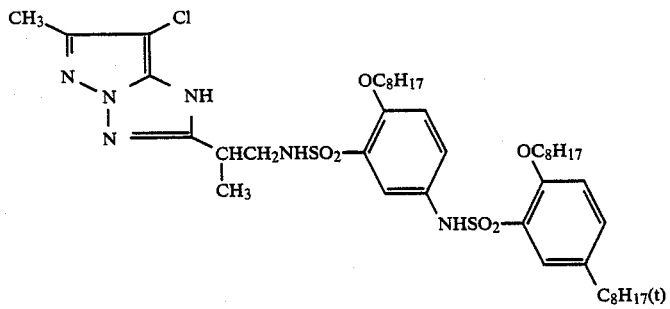
(M-5)

-continued
(M-6)
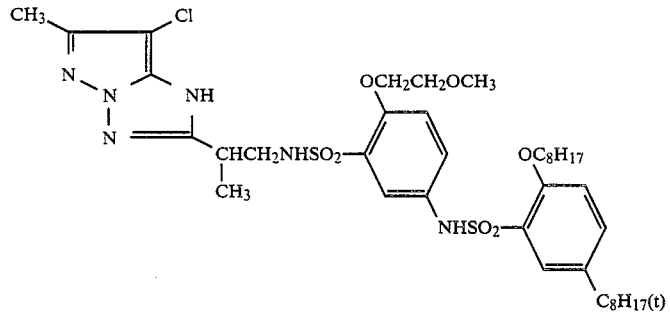
(M-7)
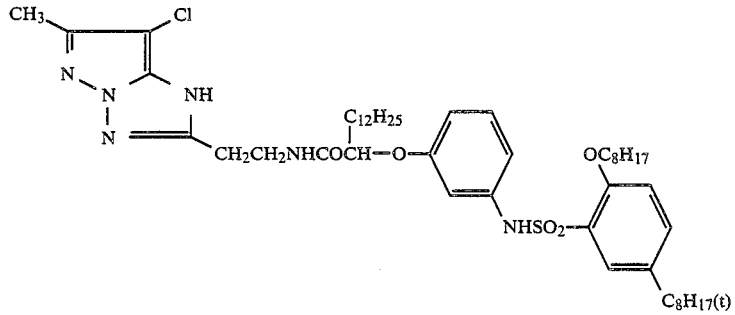
(M-9)
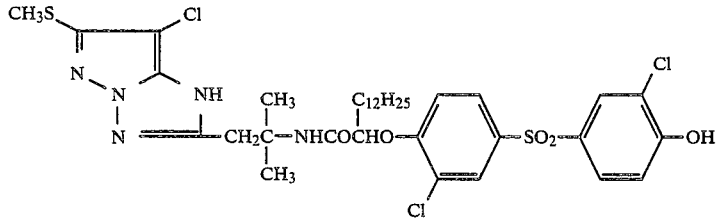
(M-11)
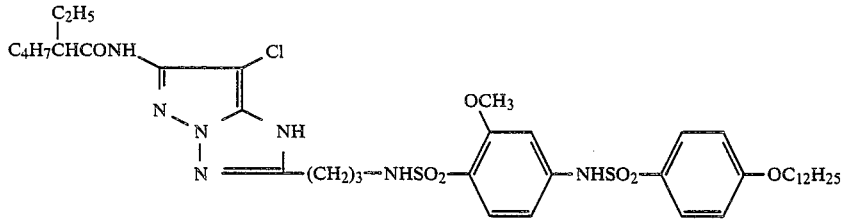
(M-12)
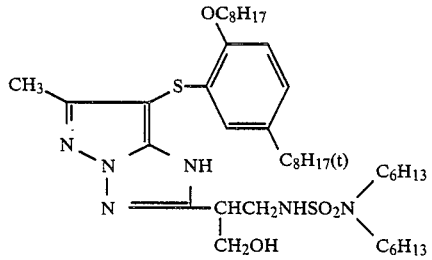
(M-15)
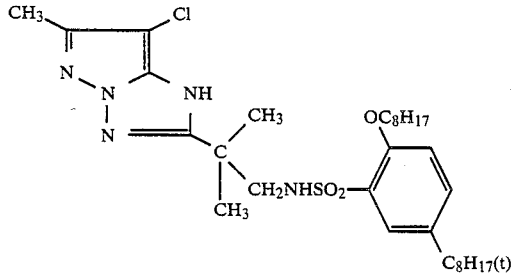

-continued
(M-19)
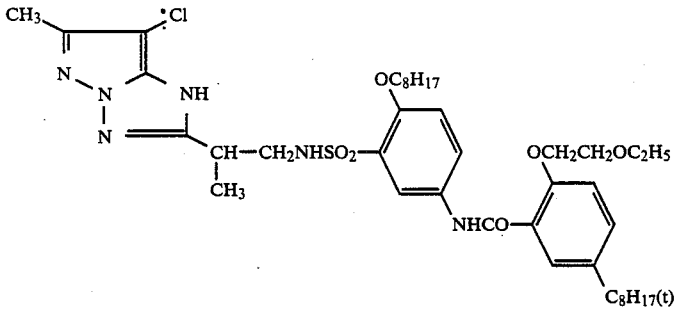
(M-20)
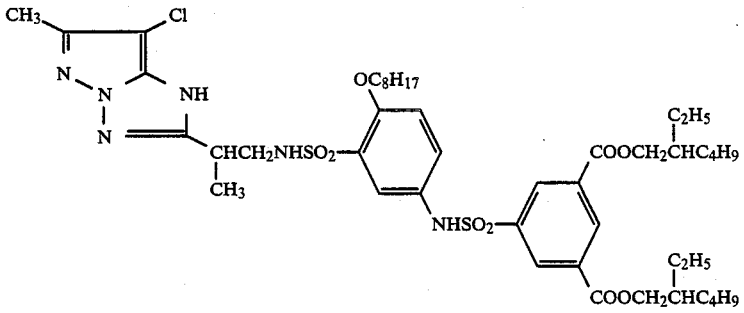
(M-28)
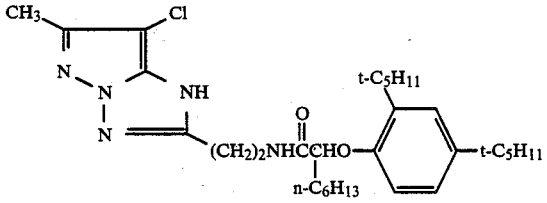
(M-32)
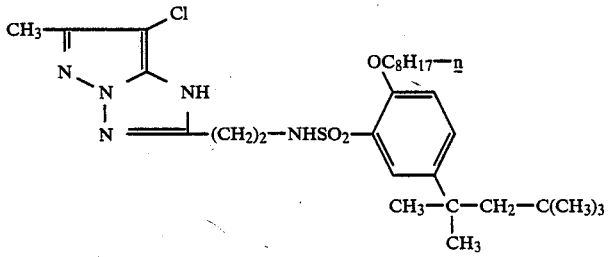
(M-33)
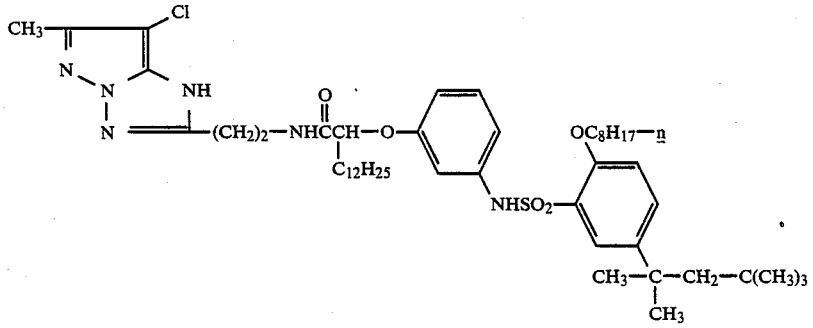

-continued
(M-34)
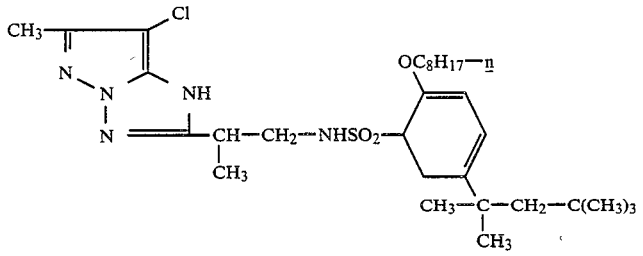
(M-36)
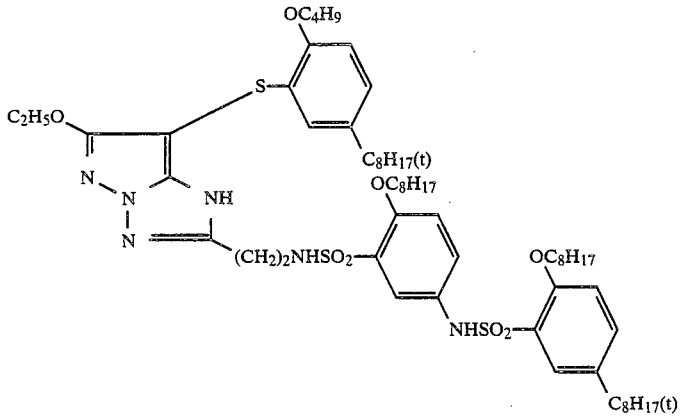
(M-37)
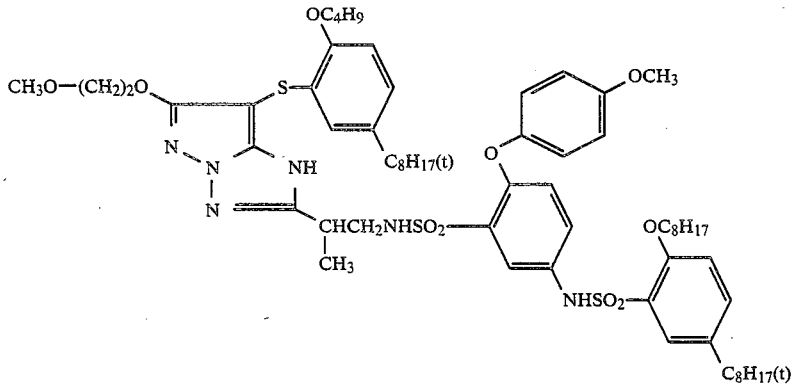
(M-39)
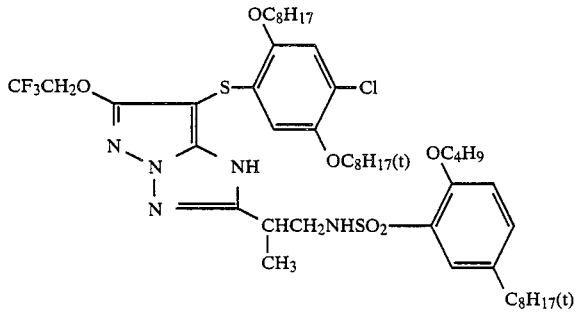
(M-43)
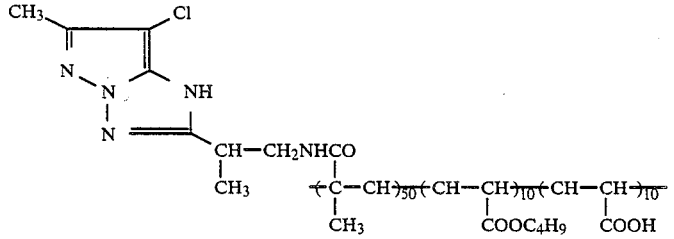

-continued

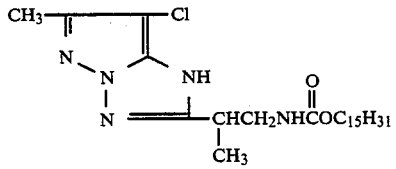

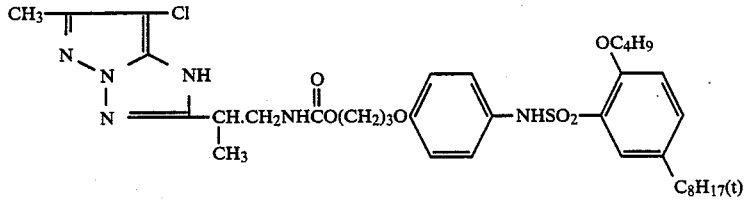

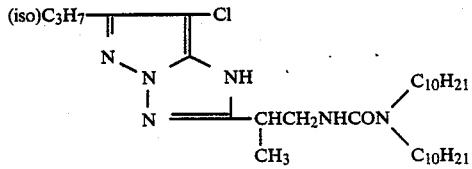

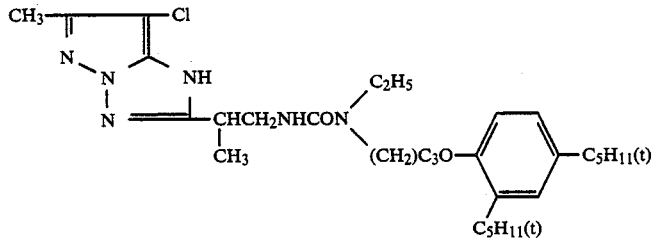

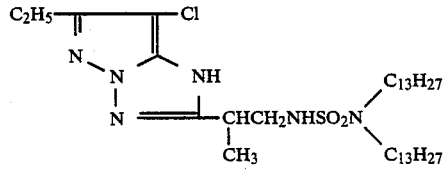

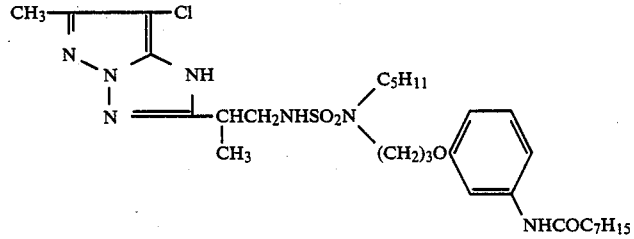

Among the high-boiling organic solvents represented by the formulae (II), (III), (IV) and (V), those wherein the total carbon atom number of $R^3$, $R^4$, $R^5$ and $R^6$ is about 8 or more generally have a dielectric constant of 4.00 or more (25° C., 10 KHz). The dielectric constant can easily be obtained by measurement using a transformer bridge ("TRS-10T", manufactured by Ando Denki K. K.).

In the formulae (II) to (V), when $R^3$, $R^4$ or $R^5$ has a substituent, the substituent may be a group having one or more linking groups selected from

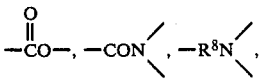

wherein $R^8$ represents a di- to hexavalent group derived from a phenyl group by removing one or more hydrogen atoms (e.g.

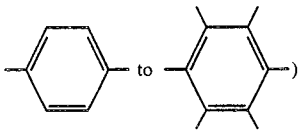

and —O—.

The alkyl group represented by $R^3$, $R^4$, $R^5$ or $R^6$ in the formulae (II) to (V) may be either straight or branched and includes, for example, a methyl group, an ethyl group, a propyl group, a butyl group, a pentyl group, a hexyl group, a heptyl group, an octyl group, a nonyl group, a decyl group, a undecyl group, a dodecyl group, a tridecyl group, a tetradecyl group, a pentadecyl group, a hexadecyl group, a heptadecyl group, an octadecyl group, a nonadecyl group, an eicosyl group, etc.

Acceptable substituents for these alkyl groups include a halogen atom, a cycloalkyl group, an aryl group and an ester group. Specific examples of the substituted alkyl group are halogen-substituted alkyl groups, e.g., $—C_2HF_4$, $—C_5H_3F_8$, $—C_9H_3F_{16}$, $—C_2H_4Cl$, $—C_3H_4Cl$, $—C_3H_5Cl_2$, $—C_3H_5Cl8r$, $—C_3H_5Br_2$, etc.; cycloalkyl-substituted alkyl groups, e.g.,

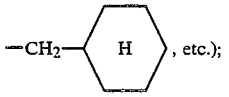

aryl-substituted alkyl group, e.g.,

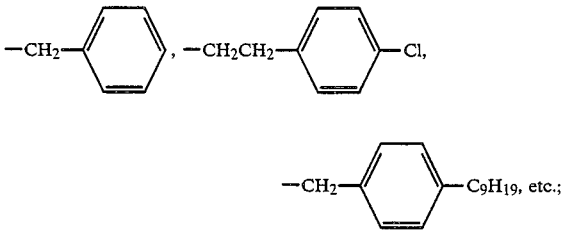

groups forming dibasic acid esters, e.g.,

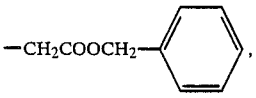

$—CH_2CH_2COOC_{12}H_{25}$, $—(CH_2)_4COOCH_2(CF_2CF_2)_2H$, $—(CH_2)_7COOC_4H_9$, $—(CH_2)_8COOC_4H_9$, etc.; groups forming lactic esters, e.g.,

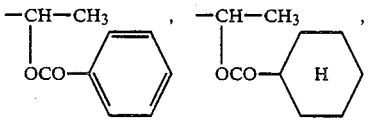

-continued

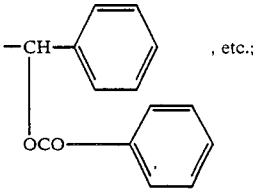

groups forming citric esters, e.g.,

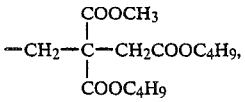

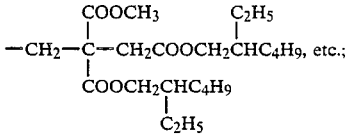

groups forming malic esters, e.g., $—CH_2CH(OH)—COOC_6H_{13}$, etc.; groups forming tartaric esters, e.g.,

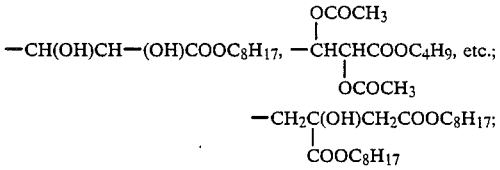

and the like.

The cycloalkyl group represented by $R_3$, $R_4$, $R_5$ or $R_6$ includes

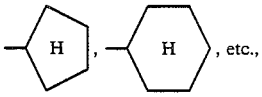

and the substituted cycloalkyl group includes

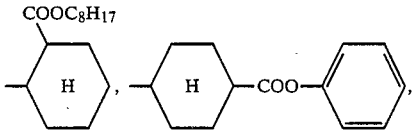

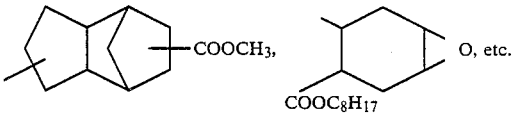

The aryl group as represented by $R_3$, $R_4$, $R_5$ $R_5$ or $R_6$ includes

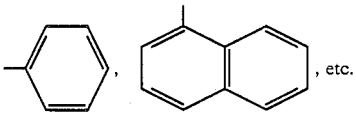

The substituted aryl group includes

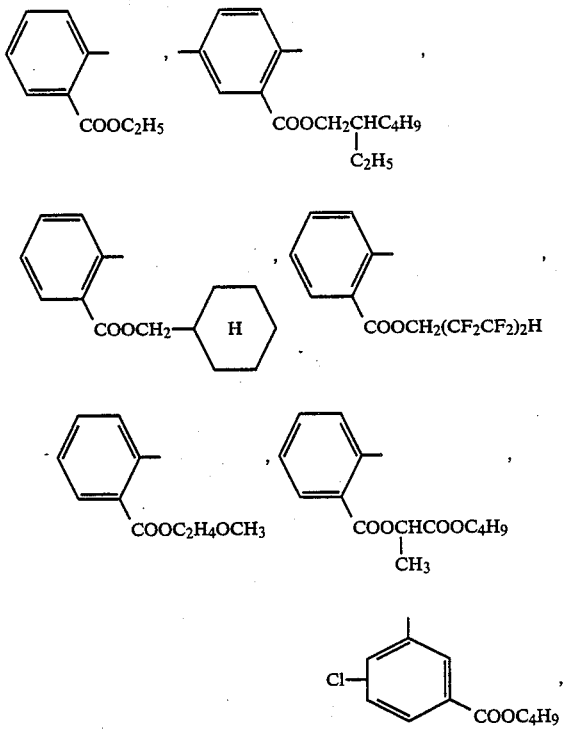

a phthalic acid, isophthalic acid, terephthalic acid or trimellitic acid ester group, e.g.,

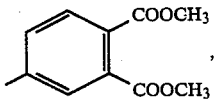

a benzoic ester group, e.g.,

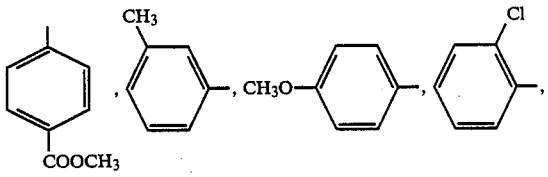

and the like.

The alkenyl group includes $-C_4H_7$, $-C_5H_9$, $-C_6H_{11}$, $-C_7H_{13}$, $-C_8H_{15}$, $-C_{10}H_{19}$, $-C_{12}H_{23}$, $-C_{18}H_{35}$, etc., and the substituted alkenyl group includes an alkenyl group substituted with a halogen atom (e.g., F, Cl, Br),

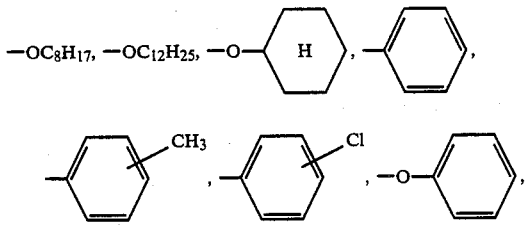

-continued

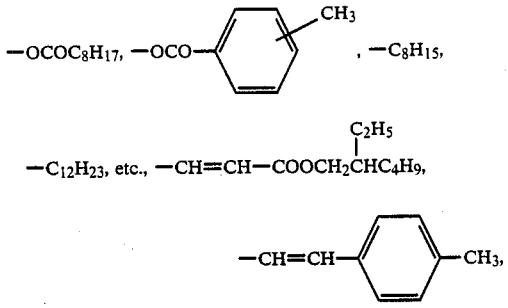

and the like.

Preferred heterocyclic groups represented by $R^3$, $R^4$ and $R^5$ are 5-, 6- or 7- membered saturated or unsaturated heterocyclic groups with at least one atom selected from N, S and O (e.g.,

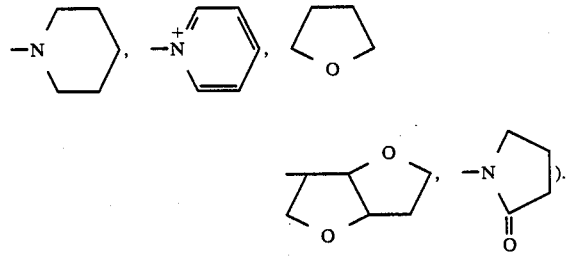

In the formula (V), $R_3$ and $R_4$ may be taken together to form an oxirane ring, an oxorane ring or an oxane ring, which may further be substituted or form a fused ring.

The above-described high-boiling organic solvents according to the present invention preferably have a dielectric constant of 5.00 or more at 25° C. and a viscosity of 20 cps or more, and more preferably 50 cps or more, at 25° C. It is surprising that use of the high-boiling organic solvent having a dielectric constant of 5.00 or more (25° C.) and a viscosity of 50 cps or more (25° C.) improves color developability without impairing absorption of developed dyes or other characteristics. The reason for this is not clear, but is probably due to the fact that high-boiling organic solvents having such a high dielectric constant cause a large developing agent uptake and that high-boiling organic solvents having a viscosity of 50 cps or more (25° C.) greatly lessen a certain adverse interaction between couplers in oil droplets and silver halides.

The amount of the high-boiling organic solvent represented by the formula (II), (III), (IV) or (V) to be used can widely be selected depending on the type and amount of the magenta coupler of the formula (I) to be used. A preferred weight ratio of high-boiling organic solvent/magenta coupler ranges from 0.05 to 20, wherein magenta coupler is generally used in $3\times10^{-3}$ to $3\times10^{-1}$ mol of coupler/Ag mol.

The high-boiling organic solvents according to the present invention can be used either alone or in combinations of two or more thereof or with other known high-boiling organic solvents within a scope meeting the purpose of the present invention. Examples of the known high-boiling organic solvents with which the solvents of this invention can be used in combination are phosphoric ester solvents, such as tricresyl phosphate, tri-2-ethylhexyl phosphate, 7-methyloctyl phosphate, tricyclohexyl phosphate, etc.; and phenolic solvents, such as 2,5-di-t-amylphenol, 2,5-di-sec-amylphenol, etc.

These may be prepared according to a conventional esterification reaction stated, for example, Kohichi Murai, "Plasticizer, its theory and application" Saiwai Shoboh, pp 393–479 (1973).

Specific examples of the high-boiling organic solvents represented by the formulae (II), (III), (IV) and (V) which can be used in the present invention are shown below, but the present invention should not be constructed as limited to the examples.

| Compound No. | Structure | Dielectric Constant (25° C., 10 KHz) | Viscosity (25° C.) (cp) |
|---|---|---|---|
| P-1 | 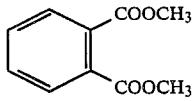 | 8.52 | 17.2 |
| P-2 | 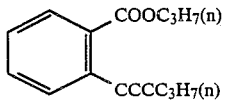 | 6.42 | 17.0 |
| P-3 | 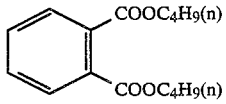 | 6.45 | 20.3 |
| P-4 | 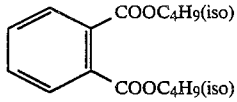 | 6.52 | 34.0 |
| P-5 | 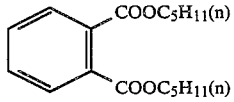 | 5.91 | 21.0 |
| P-6 | 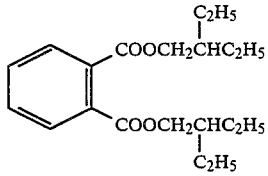 | 5.88 | 44.2 |
| P-7 | 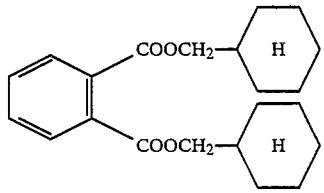 | 6.44 | 35.2 |
| P-8 | 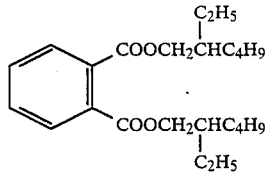 | 5.18 | 62.7 |
| P-9 | 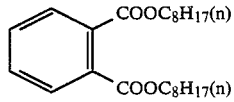 | 5.04 | 40.0 |

-continued
| Compound No. | Structure | Dielectric Constant (25° C., 10 KHz) | Viscosity (25° C.) (cp) |
|---|---|---|---|
| P-10 | 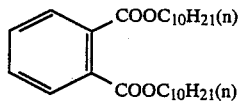 | 4.39 | 43.0 |
| P-11 | 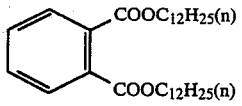 | 4.17 | 52.1 |
| P-12 | 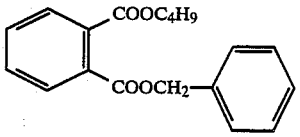 | 6.56 | 50.0 |
| P-13 | 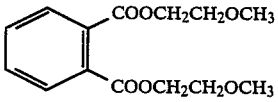 | 8.72 | 31.7 |
| P-14 | 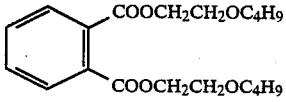 | 6.78 | 42.0 (20° C.) |
| P-15 | 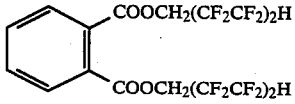 | 8.87 | 20.1 |
| P-16 | 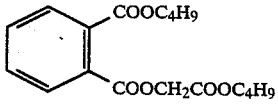 | 6.96 | 64.9 |
| P-17 | 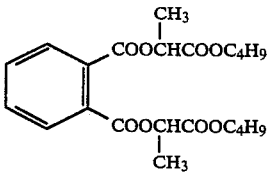 | 6.99 | 20.7 |
| P-18 | 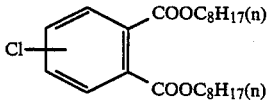 | 5.01 | 43.3 |
| P-19 | 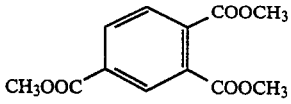 | 9.09 | 96.5 |
| P-20 | 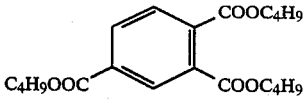 | 6.07 | 55.7 |
| P-21 | 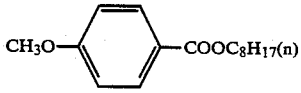 | 5.90 | 15.3 |

-continued

| Compound No. | Structure | Dielectric Constant (25° C., 10 KHz) | Viscosity (25° C.) (cp) |
|---|---|---|---|
| P-22 | $CH_3CHCOOCH_2CHC_4H_9$ (with $C_2H_5$; OCO–C$_6$H$_4$) | 5.72 | 21.3 |
| P-23 | $CH_3OCO-C(CH_2COOC_4H_9)_3$ | 6.02 | 42.7 |
| P-24 | $HO-C(CH_2COOCH_2CH(C_2H_5)C_4H_9)_3$ | 5.39 | 76.6 |
| P-25 | $CH_3OCO$–C$_6$H$_8$–$COOCH_3$ | 5.46 | 21.3 |
| P-26 | C$_6$H$_5$–$COOCH_2(CF_2CF_2)_3H$ | 6.46 | 18.4 |
| P-27 | $CHCOOCH_2(CF_2CF_2)_2H$ ‖ $CHCOOCH_2(CF_2CF_2)_2H$ | 7.67 | 53.8 |
| P-28 | $CH_2(COOCH_2-C_6H_5)_2$ | 6.12 | 17.5 |
| P-29 | $(CH_2)_4(COOCH_2(CF_2CF_2)_2H)_2$ | 7.24 | 40.4 |
| P-30 | O–C$_6$H$_8$–$(COOC_8H_{17})_2$ | 5.37 | 88.9 |
| P-31 | $C_8H_{17}-CH-CH-(CH_2)_7COOC_8H_{17}$ | 4.85 | 20.8 |
| P-32 | $C_{13}H_{27}CON(C_5H_{11})_2$ | 12.2 | 29.5 |
| P-33 | C$_6$H$_4$–$(COOC_9H_{18}CH(O)CH_2)_2$ | 5.6 | 140 |

-continued
| Compound No. | Structure | Dielectric Constant (25° C., 10 KHz) | Viscosity (25° C.) (cp) |
|---|---|---|---|
| P-34 | 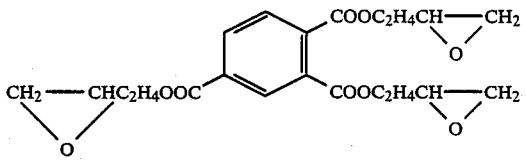 | 7.1 | |
| P-35 | 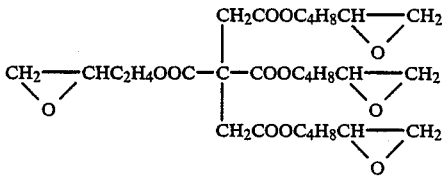 | 7.3 | |
| P-36 | 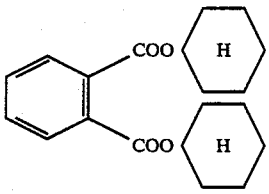 | 6.45 (measured in a super-cooled liq.) | (solid) |
| P-37 | 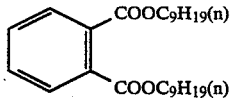 | 4.70 | 103 |
| P-38 | 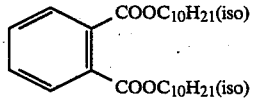 | 4.44 | 110 |
| P-39 | 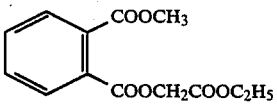 | 8.40 | 185 |
| P-40 | 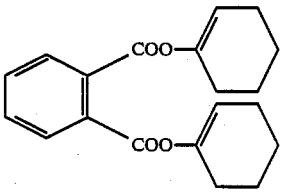 | 6.80 (determined by extra-polation) | (solid) |
| P-41 | 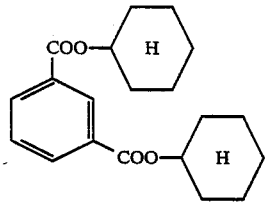 | 5.84 | above 200 |
| P-42 | 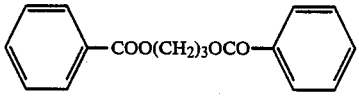 | 7.84 | (solid) |

-continued

| Compound No. | Structure | Dielectric Constant (25° C., 10 KHz) | Viscosity (25° C.) (cp) |
|---|---|---|---|
| P-43 | 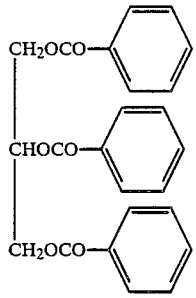 | 6.51 | (solid) |
| P-44 | 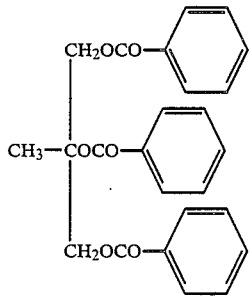 | 4.99 | (solid) |
| P-45 | 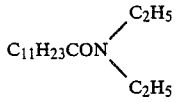 | 13.45 | |

The magenta coupler and the high-boiling organic solvent in accordance with the present invention can be dispersed in a hydrophilic organic colloidal layer constituting a photographic light-sensitive layer.

Incorporation of the coupler into a silver halide emulsion layer can generally be carried out by known methods, such as the method described in U.S. Pat. No. 2,322,027.

The high-boiling organic solvents of the invention are such that the couplers of the invention generally exhibit extremely excellent solubility therein. However, in the case when a coupler solvent to coupler ratio is too small to achieve sufficient dissolution of the coupler, other coupler solvents, such as phosphoric ester type solvents, may be used in combination. Before dissolving the coupler in the coupler solvent, an organic solvent having a boiling point of from about 30° to about 150° C. may be present. Such an organic solvent includes a lower alkyl acetate, e.g., ethyl acetate, butyl acetate, etc., ethyl propionate, sec-butyl alcohol, methyl isobutyl ketone, β-ethoxyethyl acetate, methyl cellosolve acetate, and the like.

Incorporation of the coupler dissolved in the coupler solvent as described above into a silver halide emulsion layer may be effected by a combined use of the dispersion method using a polymer as disclosed in Japanese Patent Publication No. 39853/76, Japanese patent application (OPI) No. 59943/76 (the term "OPI" as herein used means "published unexamined application"), etc.

When the coupler contains an acid group, such as a carboxyl group, a sulfo group, etc., the coupler can be introduced into a hydrophilic colloid in the form of alkaline aqueous solution.

In the present invention, various couplers other than the above-described magenta couplers can be employed. The term "coupler" means compounds capable of forming a dye upon coupling reaction with an oxidized product of an aromatic primary amine developing agent. Useful color couplers typically include naphthol or phenol type compounds, pyrazolone or pyrazoloazole type compounds and open-chain or heterocyclic ketomethylene compounds. Specific examples of the cyan, magenta and yellow couplers to be used in the present invention are described in patents cited in *Research Disclosure* (RD-17643), VII-D (December, 1978) and *Research Disclosure* (RD-18717) (November, 1979).

The color couplers to be incorporated into the light sensitive materials preferably have a ballast group or are polymerized and are, thereby, not diffusible. Two-equivalent couplers, in which the coupling active position is substituted with a coupling-releasable group, are preferred over 4-equivalent couplers, in which the coupling position is a hydrogen atom, since an amount of used silver may be remarkably reduced on using 2-equivalent coupler than 4-equivalent coupler. Further, couplers that form a dye having moderate diffusibility, colorless, couplers, DIR couplers capable of releasing a development inhibitor upon coupling reaction or couplers capable of releasing a development accelerator upon coupling can also be employed in the present invention.

Yellow couplers to be used in the invention typically include oil-protected acylacetamide couplers. Specific examples thereof are described, e.g., in U.S. Pat. Nos. 2,407,210, 2,875,057 and 3,265,506, etc. Two-equivalent yellow couplers that are preferably used in the invention, as mentioned above, typically include oxygen atom-release type yellow couplers as described in U.S. Pat. Nos. 3,408,194, 3,447,928, 3,933,501 and 4,022,620, etc.; and nitrogen atom-release type yellow couplers as described in Japanese Patent Publication No. 10739/83. U.S. Pat. Nos. 4,401,752 and 4,326,024, RD-18053 (Apr. 1979), British Pat. No. 1,425,020 and West German Patent Publication (OLS) Nos. 2,219,917, 2,261,361, 2,329,587 and 2,433,812, etc. α-Pivaloylacetanilide couplers provide dyes excellent in fastness, articularly, to light. On the other hand, α-benzoylacetanilide couplers provide high color densities.

Cyan couplers which can be used in the present invention include oil-protected naphthol type and phenol type couplers. The naphthol couplers typically include those described in U.S. Pat. No. 2,474,293, and preferably oxygen atom-release type 2-equivalent naphthol couplers as described in U.S. Pat. Nos. 4,052,212, 4,146,396, 4,228,233 and 4,296,200. Specific examples of the phenol couplers are described in U.S. Pat. Nos. 2,369,929, 2,801,171, 2,772,162 and 2,895,826, etc. Cyan couplers exhibiting moisture- and heat-fastness are advantageously used in the invention. Typical examples of such cyan couplers are phenol cyan couplers having an alkyl group of 2 or more carbon atoms at the meta-position of the phenol nucleus as disclosed in U.S. Pat. No. 3,772,002; 2,5-diacylamino-substituted phenol couplers as disclosed in U.S. Pat. Nos. 2,772,162, 3,758,308, 4,126,396, 4,334,011 and 4,327,173, West German Patent Publication (OLS) No. 3,329,729 and European Pat. No. 121,365, etc.; and phenol couplers having a phenylureido group at the 2-position and an acylamino group at the 5-position as disclosed in U.S. Pat. Nos. 3,446,622, 4,333,999, 4,451,559 and 4,427,767, etc.

In the photographic color negative light-sensitive materials, it is preferable to use a colored coupler in order to correct unnecessary absorption of the dyes produced from magenta and cyan couplers in a short wavelength region. Typical examples of the colored couplers are yellow-colored magenta couplers as described in U.S. Pat. No. 4,163,670 and Japanese Patent Publication No. 39413/82 and magenta-colored cyan couplers as described in U.S. Pat. Nos. 4,004,929 and 4,138,258 and British Pat. No. 1,146,368.

Graininess can be improved by a combined use of a coupler of the general formula (I) with a coupler forming a dye with moderate diffusion. Examples of such a coupler are described in U.S. Pat. No. 4,366,237 and British Pat. No. 2,125,570 as to magenta couplers, and in European Pat. No. 96,570 and West German Patent Publication (OLS) No. 3,234,533 as to yellow, magenta and cyan couplers.

The dye-forming couplers and the aforesaid special couplers forming a dye with moderate diffusion may form dimers or higher polymers. Typical examples of polymerized dye-forming couplers are described in U.S. Pat. Nos. 3,451,820 and 4,080,211. Specific examples of polymerized magenta couplers are given in British Pat. No. 2,102,173 and U.S. Pat. No. 4,367,282.

With the intention of fulfilling characteristic requirements for the light-sensitive materials, two or more of the above couplers may be incorporated into the same layer, or two or more different layers may contain the same coupler.

Binders or protective colloids that can be used in the emulsion layers of the light-sensitive materials of the invention include gelatin to advantage, but other hydrophilic colloids may be used alone or in combination with gelatin.

Gelatin to be used may be either lime-processed gelatin or acid-processed gelatin. Processes for preparing gelatin are described in Arther Vise, *The macromolecular Chemistry of Gelatin,* Academic Press (1964).

Silver halides to be used in the photographic emulsion layers may be any of silver bromide, silver iodobromide, silver iodochlorobromide, silver chlorobromide and silver chloride. The preferred is silver chlorobromide, and the more preferred is silver chlorobromide containing from 20 to 100 mol % of silver bromide.

The silver halide grains in the emulsion layers may have a regular crystal form, such as a cube, an octahedron, etc., or an irregular crystal form, such as a sphere, a plate, etc., or a composite form thereof. Also, the silver halide grains may be a mixture of grains having various crystal forms.

Further, an emulsion containing ultra-plate silver halide grains having a diameter 5 or more times a thickness in a proportion of 50% or more based on the total projected area of the grains may also be employed.

The silver halide grains may comprise a core and an outer shell or may be homogeneous. In addition, they may be of the type in which a latent image is predominantly formed on surfaces thereof or of the type in which a latent image is predominantly formed in the interior thereof.

The mean grain size of silver halide grains in the photographic emulsions (the grain size being defined as grain diameter if the grain has a spherical or a nearly spherical form and as a length of the edge if the grain has a cubic form, and being averaged based on projected areas of the grains) is not particularly restricted, but is preferably not greater than 2 m. The grain size distribution may be either broad or narrow.

The photographic emulsions to be used in the invention can be prepared by the processes described, e.g., in P. Glafkides, *Chimie et Physique Photographique,* Paul Montel (1967), G. F. Duffin, *Photographic Emulsion Chemistry,* Focal Press (1966), V. L. Zelikm an et al., *Making and Coating Photographic Emulsion,* Focal Press (1964), etc. In some detail, any of the acid process, the natural process, the ammonia process, etc., may be used. The manner of reaction between a soluble silver salt and a soluble halogen salt may be any of the single jet process, the double jet process and combinations thereof.

The so-called "reverse mixing process", in which grains are formed in the presence of an excess of silver ions, may also be used. Further, the so-called "controlled double jet process", in which the pAg value of the liquid phase wherein the silver halide is formed is maintained constant can also be employed. Using this process, a silver halide emulsion having a regular crystal form and an almost uniform grain size can be obtained.

During silver halide formation or physical ripening, a cadmium salt, zinc salt, a lead salt, a thallium salt, an iridium salt or a complex salt thereof, a rhodium salt or a complex salt thereof, an iron salt or a complex salt thereof, etc., may be present in the system.

The silver halide emulsion is usually subjected to chemical sensitization. Chemical sensitization can be carried out according to the method described in H. Frieser, *Die Grundlagender Photographischen Prozesse mit Silber-Halogeniden,* 675–734, Akademische Veragsgesellshaft (1968). In more detail, chemical sensitization can be carried out by sulfur sensitization using active gelatin or a sulfur-containing compound capable of reacting with silver, e.g., thiosulfates, thioureas, mercapto compounds, rhodanines, etc.; reduction sensitization using a reducing material, e.g., stannous salts, amines, hydrazine derivatives, form-amidinesulfinic acid, silane compounds, etc.; noble metal sensitization using a noble metal compound, e.g., gold complex salts and complex salts of metals of Group VIII of the Periodic Table, e.g., Pt, Ir, Pd, etc.; or combinations thereof.

For the purpose of preventing fog during preparation, preservation or photographic processing of the light-sensitive materials or stabilizing photographic performance properties, many compounds known as antifoggants or stabilizers can be added to the photographic emulsion. Such compounds include azoles, such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotraizoles, benzotriazoles, nitrobenzotriazoles, mercaptotetrazoles (particularly 1-phenyl-5-mercaptotetrazole), mercaptopyrimidines, mercaptopyrimidines, mercaptotriazines, etc.; thioketo compounds, such as oxazolidonethione, etc.; azaindenes, such as triazaindenes, tetraazaindenes (particularly, 4-hydroxy-substituted (1,3,3a,7)tetraazaindene), pentaazaindenes, etc.; benzenethiosulfonic acid, benzenesulfinic acid, benzenesulfonic acid amide, and the like.

The photographic emulsion layers or other hydrophilic colloidal layers of the light-sensitive materials of the invention can contain a wide variety of surface active agents for various purposes, such as coating aid, static charge prevention, improvement in slipperiness, emulsification and dispersion aid, prevention of adhesion, improvement in photographic characteristics (e.g., development acceleration, increase in contrast, increases in sensitivity), and the like.

The photographic emulstion layers of the light-sensitive materials of the invention can further contain polyalkylene oxides or derivatives thereof (e.g., ethers, esters, amides), thioether compounds, thiomorpholines, quaternary amonium salt compounds, urethane derivatives, urea derivatives, imidazole derivatives, 3-pyrazolidones, etc., for the purpose of increasing sensitivity or contrast or accelerating development.

The photographic emulsion layers or other hydrophilic colloidal layers of the light-sensitive materials of the invention can also contain a dispersion of a water-insoluble or sparingly water-soluble synthetic polymer for the purpose of improving dimensional stability and the like.

The photographic emulsions to be used in the invention may be spectrally sensitized with methine dyes or other dyes. Dyes to be used for spectral sensitization include cyanine dyes, merocyanine dyes, complex cyanine dyes, complex merocyanine dyes, holopolar cyanine dyes, hemicyanine dyes, styryl dyes and hemioxonol dyes. Of these, particularly useful dyes are cyanine dyes, merocyanine dyes and complex merocyanine dyes. To these dyes, any of the nuclei usually employed for cyanine dyes as basic heterocyclic nuclei can be applied. Specific examples of such nuclei are a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; the above-enumerated nuclei to which an alicyclic hydrocarbon ring is fused; and the above-enumerated nuclei to which an aromatic hydrocarbon ring is fused, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may have a substituent on the carbon atom thereof.

To the merocyanine dyes or complex merocyanine dyes, a 5- or 6-membered heterocyclic nucleus having a ketomethylene structure, such as a pyrazoline-5-one nucleus, a thiohydantoin nucleus, a 2-thiooxazolidine-2,-4-dione nucleus, a thiazolidine-2,4-dione nucleus, a rhodanine nucleus, a thiobarbituric acid nucleus, etc., can be applied.

These sensitizing dyes may be used either alone or in combination thereof. Combinations of sensitizing dyes are frequently used for the purpose of supersensitization.

The emulsions may further contain a dye which does not per se possess spectrally sensitizing activity or a substance which does not substantially absorb visible light, said dye or substance exhibiting supersensitizing activity when used in combination with a sensitizing dye. For example, aminostyryl compounds substituted with a nitrogen-containing heterocyclic group (e.g., the compounds disclosed in U.S. Pat. Nos. 2,933,390 and 3,635,721), aromatic organic acid-formaldehyde condensates (e.g., the compounds disclosed in U.S. Pat. Nos. 3,743,510), cadmium salts, azaindene compounds, and the like can be incorporated into emulsions for this purpose.

The present invention can also be applied to multilayer multicolor photographic materials comprising a support having provided thereon at least two emulsion layers having different spectral sensitivities. Multi-layer natural color photographic materials usually have at least one red-sensitive emulsion layer, at least one green-sensitive emulsion layer and at least one blue-sensitive emulsion layer on the support. The order of these layes can arbitrarily be selected according to necessity. It is usual that a red-sensitive emulsion layer contains a cyan-forming coupler, a green-sensitive emulsion layer contains a magenta-forming coupler, and a blue-sensitive emulsion layer contains a yellow-forming coupler. If desired, other combinations of emulsions and couplers may also be employed.

The photographic emulsion layers or other hydrophilic colloidal layers of the light-sensitive materials of the invention can contain an organic or inorganic hardener. Examples of usable hardeners are chromium salts, e.g., chromium alum, chromium acetate, etc., aldehydes, e.g., formaldehyde, glyoxal, glutaraldehyde, etc., N-methylol compounds, e.g., dimethylolurea, methyloldimethylhydantoin, etc., dioxane derivatives, e.g., 2,3-dihydroxydioxane, etc., active vinyl compounds, e.g., 1,3,5-triacryloyl-hexahydro-s-triazine, 1,3-vinylsulfonyl-2-propanol, etc., active halogen compounds, e.g., 2,4-dichloro-6-hydroxy-s-triazine, etc., mucohalogenic acids, e.g., mucochloric acid, mucophenoxychloric acid, etc., and combinations thereof.

In the light-sensitive materials of the invention, hydrophilic colloidal layer containing a dye or an ultraviolet absorbent may be mordanted with a cationic polymer, etc.

The light-sensitive material prepared per the invention can contain a hydroquinone derivative, an aminophenol derivative, a gallic acid derivative, an ascorbic acid derivative, etc., as a color fog preventing agent.

The light-sensitive material prepared per the invention can further contain an ultraviolet absorbent in its hydrophilic colloidal layers. Ultraviolet absorbents which can be used include benzotriazole compounds substituted with an aryl group, e.g., those described in U.S. Pat. No. 3,533,794, 4-thiazolidone compounds, e.g., those described in U.S. Pat. Nos. 3,314,794 and 3,352,681, benzophenone compounds, e.g., those described in Japanese patent application (OPI) No. 2784/71, cinnamic ester compounds, e.g., those described in U.S. Pat. Nos. 3,705,805 and 3,707,375, butadiene compounds, e.g., those described in U.S. Pat. No. 4,045,229 and bisphenol compounds, e.g., those described in U.S. Pat. No. 3,700,455. Ultraviolet absorbing couplers, such as α-naphthol type cyan-forming couplers, or ultraviolet absorbing polymers may also be employed. These ultraviolet absorbents may be fixed to a specific layer by mordanting.

The hydrophilic colloidal layers of the light-sensitive materials of the invention may contain a water-soluble dye as a filter dye or for various purpose including anti-irradiation. Such water-soluble dyes include oxonol dyes, hemioxonol dyes, styryl dyes, merocyanine dyes, cyanine dyes and azo dyes. Of these, oxonol dyes, hemioxonol dyes and merocyanine dyes are particularly useful.

In carrying out the present invention, known discoloration inhibitors, such as hydroquinone derivatives, gallic acid derivatives, p-alkoxyphenols, p-hydroxyphenol derivatives, bisphenols, and the like, can be used. The dye image stabilizers may be used either alone or in combinations of two or more thereof.

For photographic processing of the light-sensitive materials of the invention, any known methods and processing solutions as described, e.g., in *Research Disclosure,* No. 176, 28–30, can be applied. The processing temperature is usually selected from 18° C. to 50° C., but temperatures out of this range may also be employed.

A fixer of a commonly employed composition can be used in the present invention. Fixing agents to be used include thiosulfates and thiocyanates as well as organic sulfur compounds to have a fixing effect. The fixer may contain a water-soluble aluminum salt as a hardener.

A color developer generally comprises an alkaline aqueous solution containing a color developing agent. The color developing agent to be used is a conventional aromatic primary amine developing agent and includes, for example, phenylenediamines, e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline, etc.

In addition, color developing agents described in L. F. A. Mason, *Photographic Processing Chemistry,* 226–229, Focal Press (1966), U.S. Pat. Nos. 2,193,015 and 2,592,364, Japanese patent application (OPI) No. 64933/73, etc., can also be used.

The color developer can further contain a pH-buffer, such as fulfites, carbonates, borates or phosphates of alkali metals, a development restrainer or antifoggant, such as bromides, iodides and organic antifoggants. If desired, the developer can further contain a water softener, a preservative, e.g., hydroxylamine, an organic solvent, e.g., benzyl alcohol, diethylene glycol, polyethylene glycol, quaternary ammonium salts, a development accelerator, e.g., amines, a dye forming coupler, a competitive coupler, a fogging agent, e.g., sodium borohydride, an assistant developer, e.g., 1-phenyl-3-pyrazolidone, a tackifier, a polycarboxylic acid type chelating agent, an antioxidant, and the like.

The photographic emulsion layers is usually subjected to bleaching after color development. Bleaching may be carried out independently or simultaneously with fixation. Bleaching agents to be used include compounds of polyvalent metals, e.g., iron (III), cobalt (III), chromium (VI), copper (II), etc., peracids, quinones, nitroso compounds, and the like. Examples of the bleaching agent are ferricyanides, bichromates, organic complex salts of iron (III) or cobalt (III), such as complex salts with aminopolycarboxylic acids, e.g., ethylenediaminetetraacetic acid, nitrilotriacetic acid, 1,3-diamino-2-propanoltetraacetic acid, etc., or organic acids, e.g., citric acid, tartaric acid, malic acid, etc.; persulfates, permanganates; nitrosophenol, and the like. Among these bleaching agents, the particularly preferred are potassium ferricyanide, sodium (ethylenediaminetetraacetato)iron (III) and ammonium (ethylenediaminetetraacetato)iron (III). The (ethylenediaminetetraacetate)iron (III) complex salts are useful in both an independent bleaching solution and a combined bleach-fix bath.

The color photographic emulsion layer which forms a dye image layer is coated on a flexible support commonly employed for photographic light-sensitive materials, such as plastic films, paper, cloth, etc. Useful flexible supports include films made of semisynthetic or synthetic high polymers, e.g., cellulose acetate, cellulose acetate butyrate, polystyrene, polyethylene terephthalate, polycarbonate, etc.; and paper coated or laminated with a baryta layer or an α-olefin polymer, e.g., polyethylene, polypropylene, etc. The support may be colored with dyes or pigments. For light screening, the support may be black-colored.

When these supports are used for reflective materials, it is preferable to add a white pigment to the support itself or a laminate layer thereof. The white pigment which can be used includes titanium dioxide, barium sulfate, zinc oxide, zinc sulfide, calcium carbonate, antimony trioxide, silica white, alumina white, titanium phosphate, etc., with titanium dioxide, barium sulfate and zinc oxide being particularly useful.

The surface of the above-described support is generally subjected to subbing treatment in order to improve adhesion to photographic emulsions, etc. Before or after the subbing treatment, the surface of the support may be subjected to corona discharge, ultraviolet irradiation, flame treatment, and the like.

When these supports are employed in reflective materials, a hydrophilic colloidal layer densely containing a white pigment can be provided between the support and the emulsion layer for improving whiteness and sharpness of an image.

In the reflective materials using the magenta coupler according to the present invention, a paper support laminated with a polymer is frequently used, but use of synthetic resin films having dispersed therein a white pigment is particularly desirable since not only improvement in surface smoothness, surface gloss and sharpness can be brought about, but also photographic images excellent in reproduction of saturation and shadows can be obtained. In this case, useful synthetic resins are polyethylene terephthalate and cellulose acetate, and useful white pigments are barium sulfate and titanium dioxide.

The photographic materials according to the invention can be laminated on both sides thereof with a plastic film after having been development-processed and dried. Plastic films for lamination which can be used include films of polyolefins, polyesters, polyacrylic esters, polyvinyl acetate, polystyrene, a butadiene-styrene copolymer, polycarbonates, etc., with films of polyethylene terephthalate, a vinyl alcoholethylene copolymer or polyethylene being particularly useful.

This invention will now be illustratred in greater detail with reference to the following examples. In the Examples all amounts, percentages, etc., are by weight, unless othersise noted. It should be understood that they should not be construed as limiting the present invention.

EXAMPLE 1

To 9.1 g of Coupler M-19 were added 18.2 g of Solvent P-12 (dielectric constant: 6.56; viscosity: 50 cp) and 30 ml of ethyl acetate, and the mixture was dissolved by heating at 60° C. The resulting solution was added to 100 ml of an aqueous solution containing 10 g of gelatin and 1.0 g of sodium dodecylbenzenesulfonate, and the mixture was mechanically dispersed to obtain a fine dispersion. The whole dispersion was added to 100 g of a silver chlorobromide emulsion containing 80 mol % of silver bromide and 6.55 g of silver, and 10 ml of a 2% sodium salt of 2,4-dihydroxy-6-chloro-s-triazine was added thereto as a hardener. The thus prepared coating composition was coated on a paper support laminated on both sides thereof with polyethylene to a silver coverage of 180 mg/m$^2$. A gelatin layer was then provided on the coated layer to obtain a sample. This sample was designated as Sample 1.

Samples 2 to 5 were prepared in the same manner as Sample 1 (described above), but Solvent P-12 was replaced with Solvents P-14 (dielectric constant: 6.78; viscosity: 42 as measured at 20° C.), P-11 (dielectric constant: 4.17; viscosity: 52.1), P-23 (dielectric constant: 6.02; viscosity: 42.7) and P-33 (dielectric constant: 5.6; viscosity: 140), respectively.

For comparison, Samples 6 and 7 were prepared in the same manner as Sample 1 (described above), but using Comparative Compound A (shown below) having a low dielectric constant and comparative Compound B (shown below) having a low dielectric constant and a low viscosity, respectively.

For further comparison, Samples 8 and 9 were prepared in the same manner as Sample 1 (described above) but Coupler M-19 was replaced with Comparative Coupler A in both Samples (shown below) and Solvent P-12 was replaced with Solvent P-14 and Comparative Compound B, respectively.

Comparative Compound A:

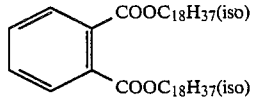

(dielectric constant: 3.61; viscosity: 117)

Comparative Compound B:

-continued

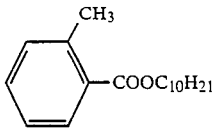

(dielectric constant: 3.61; viscosity: 7.9)

Comparative Coupler A:

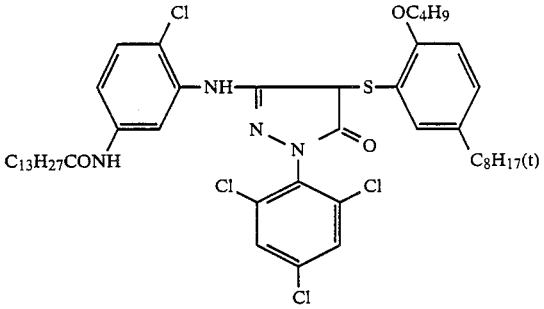

Each of Samples 1 to 8 was wedgewise exposed to light at 1,000 CMS, and then processed using the following processing solutions:

| | | |
|---|---|---|
| Developer: | | |
| Benzyl alcohol | | 15 ml |
| Diethylenetriaminepentaacetic acid | | 5 g |
| Potassium bromide | | 0.4 g |
| $Na_2SO_3$ | | 5 g |
| $Na_2CO_3$ | | 30 g |
| Hydroxylamine sulfate | | 2 g |
| 4-Amino-3-methyl-N—β-(methanesulfonamido)ethylaniline $3/2H_2SO_4.H_2O$ | | 4.5 g |
| Water to make | | 1,000 ml (pH = 10.1) |
| Bleach-Fix Bath: | | |
| Ammonium thiosulfate (70 wt %) | | 150 ml |
| $Ha_2SO_3$ | | 5 g |
| Na[Fe(EDTA)] | | 40 g |
| EDTA | | 4 g |
| Water to make | | 1,000 ml (pH = 6.8) |
| Processing Step: | Temperature | Time |
| Development | 33° C. | 3'30" |
| Bleach-Fix | 33° C. | 1'30" |
| Washing | 28~35° C. | 3' |

Thus processed samples were evaluated for photographic characteristics, and the results obtained are shown in Table 1 below.

TABLE 1

| Sample No. | Coupler | High-Boiling Organic Solvent | Photographic Characteristics: Fog | Relative Sensitivity* | Density at Shoulder** |
|---|---|---|---|---|---|
| 1 | M-19 | P-12 | 0.09 | 116 | 2.36 |
| 2 | " | P-14 | 0.09 | 119 | 2.40 |
| 3 | " | P-11 | 0.09 | 112 | 2.31 |
| 4 | " | P-23 | 0.09 | 124 | 2.47 |
| 5 | " | P-33 | 0.09 | 114 | 2.33 |
| 6 | " | Comparative Compound A | 0.10 | 103 | 2.14 |
| 7 | " | Comparative Compound B | 0.07 | 97 | 2.19 |
| 8 | Comparative Coupler A | P-14 | 0.10 | 100 | 2.20 |
| 9 | " | Comparative | 0.08 | 92 | 2.03 |

TABLE 1-continued

| Sample No. | Coupler | High-Boiling Organic Solvent | Photographic Characteristics Fog | Relative Sensitivity* | Density at Shoulder** |
|---|---|---|---|---|---|
| | | Compound B | | | |

Note:
*: Relative sensitivity is a relative value of a logE value that provides a density of fog + 0.5, the sensitivity of Sample 8 being taken as 100 (standard).
**: Density at Shoulder is a density ($D_G$) at an exposure higher than logE that provides a density of fog + 0.5 (sensitivity point) by logE = 0.5.

As can be seen from the results of Table 1, a combination of the coupler and high boiling organic solvent in accordance with the present invention brings about remarkable improvements in sensitivity and density at the portion near to the maximum density (i.e., density at the shoulder) over the conventional pyrazolone couplers. Further, combined use per the present invention prevents fog.

Moreover, the dye images produced from the magenta couplers according to the present invention show no second absorption in the short wavelength side and lower absorption densities in the long wavelength side as compared with Comparative Coupler A (5-pyrazolone coupler) and, therefore, exhibit a distinct magenta hue.

Once the above tests were complete, Samples 1 to 9 were evaluated for fastness to moisture and heat by discoloration testing using a fade meter and a fluorescent lamp (light source) (15,000 1×) at 60° C., 70% RH for 20 days. The results obtained are shown in Table 2 below.

TABLE 2

| Sample No. | Coupler | High-Boiling Organic Solvent | Change in Magenta Density (Initial $D_G$ = 1.0) | Stain $D_B$ |
|---|---|---|---|---|
| 1 | M-19 | P-12 | 0.98 | 0.10 |
| 2 | " | P-14 | 0.98 | 0.10 |
| 3 | " | P-11 | 0.97 | 0.11 |
| 4 | " | P-23 | 0.98 | 0.10 |
| 5 | " | " | 0.79 | 0.10 |
| 6 | " | Comparative Compound A | 0.95 | 0.12 |
| 7 | " | Comparative Compound B | 0.94 | 0.08 |
| 8 | Comparative Coupler A | P-14 | 0.94 | 0.35 |
| 9 | Comparative Coupler A | Comparative Compound B | 0.91 | 0.39 |

It can be seen from the results of Table 2 above that materials containing the combination of coupler and high-boiling organic solvent according to the present invention exhibit excellent properties; in particular, that the dye images are highly fast to moisture and heat and, also, are free from stain formation resulting from decomposition of couplers.

EXAMPLE 2

A coating composition was prepared in the same manner as described in Example 1, but using 9.6 g of Coupler M-5, 19.0 g of Solvent P-19 and 30 ml of ethyl acetate. The resulting coating composition was used for the preparation of Sample 11. A coating composition for Sample 12 was prepared in the same manner, but using 6.2 g of Coupler M-4, 12.5 g of Solvent P-8 and 30 ml of ethyl acetate. Further, a coating composition for Sample 13 was prepared in the same manner, but using Comparative Coupler A and Comparative Compound A as used in Example 1.

Using each of the thus prepared coating compositions, a support having polyethylene laminated on both sides was coated with a first layer (the lowermost layer) to a seventh layer (the uppermost layer) as shown below to produce color photographic light-sensitive materials (Samples 11 to 13).

The coating composition for each emulsion layer was prepared in accordance with the procedure shown in the preceding examples.

| | |
|---|---|
| 7th Layer: (Protective Layer) | |
| Gelatin | 1600 mg/m$^2$ |
| 6th Layer: (Ultraviolet-Absorbing Layer) | |
| Ultraviolet absorbent*1 | 350 mg/m$^2$ |
| Solvent*2 | 140 mg/m$^2$ |
| Gelatin | 1000 mg/m$^2$ |
| 5th Layer: (Red-Sensitive Layer) | |
| Silver chlorobromide emulsion (silver bromide: 80 mol %) | 250 mg/m$^2$ ($8 \times 10^{-4}$ mol-Ag/m$^2$) |
| Cyan coupler*3 | 400 mg/m$^2$ |
| Ultraviolet absorbent*1 | 100 mg/m$^2$ |
| Solvent*2 | 200 mg/m$^2$ |
| Gelatin | 600 mg/m$^2$ |
| 4th Layer: (Color Mixing Preventing Layer) | |
| Color mixing preventing agent*4 | 200 mg/m$^2$ |
| Ultraviolet absorbent*1 | 150 mg/m$^2$ |
| Solvent*2 | 140 mg/m$^2$ |
| Gelatin | 1000 mg/m$^2$ |
| 3rd Layer: (Green-Sensitive Layer) | |
| Silver chlorobromide emulsion (silver bromide: 80 mol %) | 180 mg/m$^2$ ($3 \times 10^{-4}$ mol-Ag/m$^2$) |
| Magenta coupler and Solvent*5 | 270 mg/m$^2$ |
| Discoloration preventing agent*6 | 150 mg/m$^2$ |
| Solvent*7 | 170 mg/m$^2$ |
| Gelatin | 1000 mg/m$^2$ |
| 2nd Layer: (Color Mixing Preventing Layer) | |
| Color mixing preventing agent*4 | 200 mg/m$^2$ |
| Solvent*2 | 80 mg/m$^2$ |
| Gelatin | 1000 mg/m$^2$ |
| 1st Layer: (Blue-Sensitive Layer) | |
| Silver chlorobromide emulsion (silver bromide: 80 mol %) | 400 mg/m$^2$ ($8.5 \times 10^{-4}$ mol-Ag/m$^2$) |
| Yellow coupler*8 | 680 mg/m$^2$ |
| Solvent*2 | 280 mg/m$^2$ |
| Gelatin | 1200 mg/m$^2$ |

Note:
*1 2-(2-Hydroxy-3-sec-butyl-5-t-butylphenyl)-benzotriazole
*2 Dibutyl phthalate
*3 2-[α-(2,4-Di-t-amylphenoxy)butylamido]-2,4-dichloro-5-ethylphenol
*4 2,5-Di-t-octylhydroquinone
*5 Combination of Coupler M-5 and Solvent P-19; Coupler M-4 and Solvent P-8; or Comparative Coupler A and Comparative Compound A (as described above).
*6 3,3,3',3'-Tetramethyl-5,6,5'6'-tetrapropyl-oxy-bis-1,1'-spiroindane
*7 Trioctyl phosphate
*8 α-Pivaloyl-α-(3-benzyl-4-ethoxy-1-hydantoinyl-2-chloro-5-[α-(2,4-di-t-amylphenoxy)butylamido]acetanilide The sensitizing dye used in each emulsion layer was as follows:

Blue-sensitive emulsion layer: 3,3'-Di-(γ-sulfopropyl)-selenacyanine sodium salt ($2 \times 10^{-4}$ mol per mol of silver halide)

Green-sensitive emulsion layer: 3,3'-Di-(γ-sulfopropyl-5,5'-diphenyl-9-ethyloxacarbocyanine sodium salt ($2.5 \times 10^{-4}$ mol per mol of silver halide)

Red-sensitive emulsion layer: 3,3'-Di-(γ-sulfopropyl)-9-methyl-thiadicarbocyanine sodium salt ($2.5 \times 10^{-4}$ mol per mol of silver halide)

EXAMPLE 3

To 9.9 g of Coupler M-34 were added 10.0 g of Solvent P-8 and 20 g of ethyl acetate, and the mixture was heated at 60° C. to dissolve. The resulting solution was added to 100 ml of an aqueous solution containing 10 g of gelatin and 1.0 g of sodium dodecyl-benzenesulfonate, followed by mechanically dispersing to obtain a fine dispersion. The whole dispersion was added to 100 g of a silver chlorobromide emulsion containing 90 mol % of silver bromide and 6.55 g of silver, and 10 ml of a 2% sodium salt of 2,4-dihydroxy-6-chloro-s-triazine was added thereto as a hardener. The resulting coating composition was coated on a clear acetate support to a silver coverage of 600 mg/m². A gelatin layer was then formed on the coated layer as a protective layer. The resulting sample was designated as Sample 121.

Sample 122 was prepared in the same manner as Sample 121 (described above), but using Solvent P-19 in place of Solvent P-8.

Samples 123 and 124 were prepared in the same manner as Sample 121 (described above) except that Coupler M-34 was replaced with 10.1 g of Coupler M-15 in both Samples, to which, 10 g of Solvent P-8 and Solvent P-19 and 20 ml of ethyl acetate were added, respectively.

For comparison, Sample 25 was prepared in the same manner as Sample 121 (described above), except for using Comparative Coupler which disclosed hereunder as a magenta coupler and Solvent P-8 as a high-boiling organic solvent.

Each of Samples 121 to 125 was wedgewise exposed to light at 200 CMS and then processed according to the following procedure with the following processing solutions:

Comparative Coupler

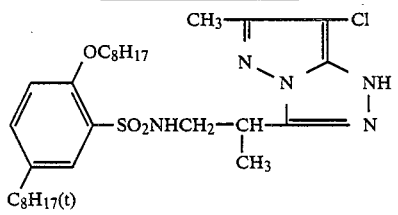

| Procedure | Temperature | Time |
|---|---|---|
| 1. Color Development | 36.7° C. | 3'00" |
| 2. Stop | 27° C. | 40" |
| 3. Washing | 27° C. | 40" |
| 4. First Fixation | 27° C. | 40" |
| 5. Washing | 27° C. | 40" |
| 6. Acceleration | 27° C. | 40" |
| 7. Bleach | 27° C. | 40" |
| 8. Washing | 27° C. | 40" |
| 9. Second Fixation | 37° C. | 40" |
| 10. Washing | 27° C. | 1'00" |
| 11. Stabilization | 27° C. | 10" |

| Developer Formulation: | |
|---|---|
| Sodium sulfite | 4.35 g |
| 4-Amino-3-methyl-N,N—diethylaniline | 2.95 g |
| Sodium carbonate | 17.10 g |
| Potassium bromide | 1.72 g |
| Water to make | 1,000 ml (pH = 10.5) |
| **Stopper Formulation:** | |
| Sulfuric acid (6N) | 50 ml |
| Water to make | 1,000 ml (pH = 1.0) |
| **1st and 2nd Fixer Formulation:** | |
| Ammonium thiosulfate | 60 g |
| Sodium sulfite | 2.5 g |

-continued

Comparative Coupler

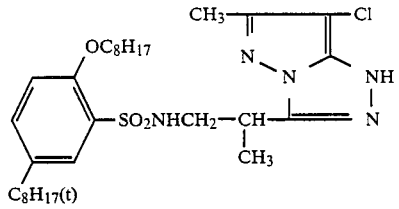

| | |
|---|---|
| Sodium hydrogensulfite | 10.3 g |
| Potassium iodide | 0.5 g |
| Water to make | 1,000 ml (pH = 5.8) |
| **Accelerating Solution Formulation:** | |
| Sodium pyrosulfite | 3.3 g |
| Glacial acetic acid | 5.0 ml |
| PBA-1 (Persulfuric acid bleach accelerator produced by Eastman Kodak) | 3.3 g |
| Tetrasodium ethylenediamine-tetraacetate (EDTA) | 0.5 g |
| Water to make | 1,000 ml (pH = 4.0) |
| **Bleaching Solution Formulation:** | |
| Sodium persulfate | 33.0 g |
| Sodium chloride | 15.0 g |
| Sodium dihydrogenphosphate | 7.0 g |
| Phosphoric acid (85% aq. soln.) | 2.5 ml |
| Water to make | 1,000 ml (pH = 2.3) |

Each of the thus processed samples was evaluated for photographic characteristics, and the results obtained are shown in Table C below. In Table C, the relative sensitivity is a relative value of a log E value that provides a density of fog+1.0, the sensitivity of Sample 23 being taken as 100 (standard).

TABLE C

| Sample No. | Coupler | High-Boiling Organic Solvent | Photographic Characteristics: Fog | Relative Sensitivity | Gamma | Maximum Density |
|---|---|---|---|---|---|---|
| 121 | M-34 | P-8 | 0.04 | 138 | 3.21 | 3.86 |
| 122 | M-34 | P-19 | 0.04 | 142 | 3.29 | 3.88 |
| 123 | M-15 | P-8 | 0.04 | 133 | 3.15 | 3.85 |
| 124 | M-15 | P-19 | 0.04 | 136 | 3.24 | 3.86 |
| 125 | Comparative Coupler | P-8 | 0.06 | 100 | 2.36 | 3.42 |

As seen in the results of Table C, it is found that a combination use of the coupler and the high boiling point organic solvent of the present invention shows remarkably superior photographic characteristics in, for example, sensitivity, gradation, and the highest color density to a pyrazolotriazole coupler, which as different from a pyrazolotriazole coupler of the present invention.

EXAMPLE 4

A paper support having polyethylene laminated on both sides was coated with a first layer (bottom layer) through an eleventh layer (top layer) as shown below to produce a color photographic light-sensitive material. The polyethylene laminate layer on the side on which the bottom layer was to be coated contained titanium white as a white pigment and a trace amount of ultramarine as a blue dye.

| | |
|---|---|
| 1st Layer: (Antihalation Layer) | |
| Black colloidal silver | 0.01 g/m$^2$ |
| Gelatin | 0.2 g/m$^2$ |
| 2nd Layer: (Low Red-Sensitive Layer) | |
| Silver iodobromide emulsion (silver iodide: 3.5 mol %; mean grain size: 0.7 μm, spectrally sensitized with red-sensitizing dyes*5,*4 | 0.15 g-Ag/m$^2$ |
| Gelatin | 1.0 g/m$^2$ |
| Cyan coupler*3 | 0.30 g/m$^2$ |
| Discoloration inhibitor*2 | 0.15 g/m$^2$ |
| Coupler solvent*18,*1 | 0.06 g/m$^2$ |
| 3rd Layer: (High Sensitive Red-Sensitive Layer) | |
| Silver iodobromide emulsion (silver iodide: 8.0 mol %; mean grain size: 0.7 μm; spectrally sensitized with red-sensitizing dyes*5,*4 | 0.10 mg-Ag/m$^2$ |
| Gelatin | 0.50 g/m$^2$ |
| Cyan coupler*3 | 0.10 g/m$^2$ |
| Discoloration inhibitor*2 | 0.05 g/m$^2$ |
| Coupler solvent*18,*1 | 0.02 g/m$^2$ |
| 4th Layer: (Intermediate Layer) | |
| Yellow colloidal silver | 0.02 g/m$^2$ |
| Gelatin | 1.00 g/m$^2$ |
| Color mixing preventing agent*14 | 0.08 g/m$^2$ |
| Color mixing preventing agent solvent*13 | 0.16 g/m$^2$ |
| Polymer latex*6 | 0.40 g/m$^2$ |
| 5th Layer: (Low Sensitive Green-Sensitive Layer) | |
| Silver iodobromide emulsion (silver iodide: 2.5 mol %; mean grain size: 0.4 μm; spectrally sensitized with green sensitizing dye*12 | 0.20 g-Ag/m$^2$ |
| Gelatin | 0.70 g/m$^2$ |
| Magenta coupler*11 | 0.40 g/m$^2$ |
| Discoloration inhibitor A*10 | 0.05 mg/m$^2$ |
| Discoloration inhibitor B*9 | 0.05 mg/m$^2$ |
| Coupler solvent*7 | 0.40 g/m$^2$ |
| 6th Layer: (High Sensitive Green-Sensitive Layer) | |
| Silver iodobromide emulsion (silver iodide: 3.5 mol %; mean grain size: 0.9 μm; spectrally sensitized with green-sensitizing dye*12 | 0.20 g-Ag/m$^2$ |
| Gelatin | 0.70 g/m$^2$ |
| Magenta coupler*11 | 0.40 g/m$^2$ |
| Discoloration inhibitor A*10 | 0.05 g/m$^2$ |
| Discoloration inhibitor B*9 | 0.05 g/m$^2$ |
| Discoloration inhibitor C*8 | 0.02 g/m$^2$ |
| Coupler solvent*18 | 0.40 g/m$^2$ |
| 7th Layer: (Yellow Filter Layer) | |
| Yellow colloidal silver | 0.20 g/m$^2$ |
| Gelatin | 1.00 g/m$^2$ |
| Color mixing preventing agent*14 | 0.06 g/m$^2$ |
| Color mixing preventing agent solvent*13 | 0.24 g/m$^2$ |
| 8th Layer: (Low Sensitive Blue-Sensitive Layer) | |
| Silver iodobromide emulsion (silver iodide: 2.5 mol %; mean grain size: 0.5 μm; spectrally sensitized with blue sensitizing dye*16 | 0.15 g-Ag/m$^2$ |
| Gelatin | 0.50 g/m$^2$ |
| Yellow coupler*15 | 0.20 g/m$^2$ |
| Coupler solvent*18 | 0.05 g/m$^2$ |
| 9th Layer: (High Sensitive Blue-Sensitive Layer) | |
| Silver iodobromide emulsion (silver iodide: 2.5 mol %; mean grain size: 1.4 μm; spectrally sensitized with blue-sensitizing dye*16 | 0.20 g-Ag/m$^2$ |
| Gelatin | 0.50 g/m$^2$ |

-continued

| | |
|---|---|
| Yellow coupler*15 | 0.20 g/m$^2$ |
| Coupler solvent*18 | 0.05 g/m$^2$ |
| 10th Layer: (Ultraviolet Absorbing Layer) | |
| Gelatin | 1.50 g/m$^2$ |
| Ultraviolet absorbent*19 | 1.0 g/m$^2$ |
| Ultraviolet absorbent solvent*18 | 0.30 g/m$^2$ |
| Color mixing preventing agent*17 | 0.08 g/m$^2$ |
| 11th Layer: (Protective Layer) | |
| Gelatin | 1.0 g/m$^2$ |

The compounds used in the preparation of the sample were as follows:
*1Dioctyl phthalate
*2 2-(2-Hydroxy-3-sec-butyl-5-t-butylphenyl)benzotriazole
*3 2-[α-(2,4-Di-t-amylphenoxy)butylamido]-4,6-dichloro-5-ethylphenol
*4 5,5'-Dichloro-3,3'-di(3-sulfobutyl)-9-ethylthiacarbonylcyanine sodium salt
*5 Triethylammonium-3-[2-{2-[3-sulfopropyl)-naphtho(1,2-d)thiazolin-2-ylidenemethyl]-1-butenyl}-3-naphtho(1,2-d)thiazolino]propane-sulfonate
*6 Polyethyl acrylate
*7 Trioctyl phosphate
*8 2,4-Di-t-hexylhydroquinone
*9 Di-(2-hydroxy-3-t-butyl-5-methylphenyl)methane
*10 3,3,3',3'-Tetramethyl-5,6,5',6'-tetrapropoxy-1,1'-bisspiroindane
*11 1-(2,4,6-Trichlorophenyl)-3-(2-Chloro-5-tetra-decaneamido)anilino-2-pyrazolino-5-one
*12 5,5'-Diphenyl-9-ethyl-3,3'-disulfopropyloxacarbocyanine sodium salt
*13 o-Cresyl phosphate
*14 2,4-Di-t-octylhydroquinone
*15 α-Pivaloyl-α-[2,4-dioxo-1-benzyl-5-ethoxy-hydantoin-3-yl)-2-chloro-5-(α-2,4-dioxo-t-amylphenoxy)butaneamino]acetanilide
*16 Triethylammonium 3-[2-(3-benzylrhodanin-5-ylidene)-3-benzoxazolinyl]propanesulfonate
*17 2,4-Di-sec-octylhydroquinone
*18 Trioctyl phosphate
*19 5-Chloro-2-(2-hydroxy-3-t-butyl-5-t-octyl)-phenylbenzotriazole In addition to the above-described components, each layer further contained 1,4-bis(vinylsulfonylacetamido)ethane as a gelatin hardener and a surface active agent. The thus prepared light-sensitive material was designated as Sample 31, which was used as a comparative sample.

Sample 32 was prepared in the same manner as Sample 31, except the formulations of the 5th layer (low sensitive green-sensitive layer) and the 6th layer (high sensitive green-sensitive layer) were replaced with the following formulations:

| | |
|---|---|
| 5th Layer: (Low Sensitive Green-Sensitive Layer) | |
| The same silver iodobromide emulsion as used in the 5th layer of Sample 31 (silver iodide 2.5 mol %, average particle size 0.4 μm) | 0.10 g-Ag/m$^2$ |
| Gelatin | 0.70 g/m$^2$ |
| Magenta Coupler M-5 | 0.59 g/m$^2$ |
| Discoloration Inhibitor A*10 | 0.07 g/m$^2$ |
| Discoloration Inhibitor B*9 | 0.02 g/m$^2$ |
| Coupler solvent*18 | 0.59 g/m$^2$ |
| 6th Layer: (High Sensitive Green-Sensitive Layer) | |
| The same silver iodobromide emulsion as used in the 6th layer of Sample 31 (silver iodide 3.5 mol %, average particle size 0.9 μm) | 0.10 g-Ag/m$^2$ |
| Gelatin | 0.70 g/m$^2$ |
| Magenta Coupler M-5 | 0.59 g/m$^2$ |
| Discoloration Inhibitor A*10 | 0.07 g/m$^2$ |
| Discoloration Inhibitor B*9 | 0.02 g/m$^2$ |
| Coupler solvent*18 | 0.59 g/m$^2$ |

Sample 33 was prepared in the same manner as for Sample 31, except the formulations of the 5th and 6th layers were replaced with the following formulations:

| | |
|---|---|
| 5th Layer: (Low Sensitive Green-Sensitive Layer) | |
| The same silver iodobromide emulsion as used in the 5th | 0.10 g-Ag/m$^2$ |

-continued

| | |
|---|---|
| layer of Sample 31 (silver iodide 2.5 mol %, average particle size: 0.4 μm) | |
| Gelatin | 0.70 g/m$^2$ |
| Magenta Coupler M-5 | 0.59 g/m$^2$ |
| Discoloration Inhibitor A*[10] | 0.07 g/m$^2$ |
| Discoloration Inhibitor B*[9] | 0.02 g/m$^2$ |
| Coupler Solvent P-8 | 0.59 g/m$^2$ |
| 6th Layer: (High Sensitive Green-Sensitive Layer) | |
| The same silver iodobromide emulsion as used in the 6th layer of Sample 31 (silver iodide 3.5 mol %, average particle size: 0.9 μm) | 0.10 g-Ag/m$^2$ |
| Gelatin | 0.70 g/m$^2$ |
| Magenta Coupler M-5 | 0.59 g/m$^2$ |
| Discoloration inhibitor A*[10] | 0.07 g/m$^2$ |
| Discoloration inhibitor B*[9] | 0.02 g/m$^2$ |
| Coupler Solvent P-8 | 0.59 g/m$^2$ |

Each of Samples 31 to 33 were wedgewise exposed to light in a usual manner and subjected to the following development processing.

| Development Processing: | | |
|---|---|---|
| First development (black-and-white development) | 38° C. | 1'15" |
| Washing | 38° C. | 1'30" |
| Reversal exposure | above 100 | above 1" |
| Color development | 38° C. | 2'15" |
| Washing | 38° C. | 45" |
| Bleach-fix | 38° C. | 2'00". |
| Washing | 38° C. | 2'15" |

Processing Solution

| First Development Formulation: | |
|---|---|
| Pentasodium nitrilo-N,N,N—tri methylenephosphonate | 0.6 g |
| Pentasodium diethylenetriamine-pentaacetate | 4.0 g |
| Potassium sulfite | 30.0 g |
| Potassium thiocyanate | 1.2 g |
| Potassium carbonate | 35.0 g |
| Potassium hydroquinonemonosulfonate | 25.0 g |
| Diethylene glycol | 15.0 ml |
| 1-Phenyl-4-hydroxymethyl-4-methyl-3-pyrazolidone | 2.0 g |
| Potassium bromide | 0.5 g |
| potassium iodide | 5.0 mg |
| Water to make | 1,000 ml (pH = 9.70) |
| **Color Developer Formulation:** | |
| Benzyl alcohol | 15.0 ml |
| Diethylene glycol | 12.0 ml |
| 3,6-Dithia-1,8-octandediol | 0.2 g |
| Pentasodium nitrilo-N,N,N—tri-methylenephosphonate | |
| Pentasodium diethylenetri-aminepentaacetate | 2.0 g |
| Sodium sulfite | 2.0 g |
| Potassium carbonate | 25.0 g |
| Hydroxylamine sulfate | 3.0 g |
| N—Ethyl-N—(β-methanesulfonamido-ethyl)-3-methyl-4-aminoaniline sulfate | 5.0 g |
| Potassium bromide | 0.5 g |
| Potassium iodide | 1.0 mg |
| Water to make | 1,000 ml (pH = 10.40) |
| **Bleach-Fix Bath Formulation:** | |
| 2-Mercapto-1,3,4-triazole | 1.0 g |
| Disodium ethylenediaminetetra-acetate dihydrate | 5.0 g |
| Ammonium (ethylenediaminetetra-acetato)Fe(III) monohydrate | 80.0 g |
| Sodium sulfite | 15.0 g |
| Sodium Thiosulfate (700 g/liter solution) | 160.0 ml |
| Glacial acetic acid | 5.0 ml |
| Water to make | 1,000 ml (pH = 6.50) |

The thus processed samples were evaluated for photographic characteristics, and the results obtained are shown in Table 4. The density measurements were conducted by the use of Standard Densitometer, FSD-103 manufactured by Fuji Photo Film Co., Ltd.

TABLE 4

| Sample No. | Silver Coverage (g/m$^2$) | Maximum Density | Dye Image Stability: Percent Remaining (%) | Dye Image Stability: Stain** |
|---|---|---|---|---|
| 31 (Comparison) | 1.20 | 2.47 | 90 | 0.28 |
| 32 (Comparison) | 1.12 | 2.53 | 94 | 0.13 |
| 33 (Invention) | 1.10 | 2.78 | 97 | 0.08 |

Note:
*: Percent of remaining magenta density after irradiation with xenon light of 100,000 lux for 12 days.
**: (Yellow stain density after preservation at 60° C., 70% RH for 6 weeks) - (yellow stain density immediately after the development)

As is apparent from the results of Table 4, Sample 33 in which the coupler of the invention and the high-boiling organic solvent of the invention were used is excellent in color density, dye image stability and freedom from stain formation that impairs image quality. Further, the dye image of sample 33 showed a distinct magenta color of high saturation.

EXAMPLE 5

Sample 41 was prepared by coating a triacetate film base with the following 1st to 12th layers in the order listed.

1st Layer: (Antihalation Layer)

Fifteen grams of 5-chloro-2-(2-hydroxy-3,5-di-t-butylphenyl)-2H-benzotriazole, 30 g of 2-(2-hydroxy-5-t-butylphenyl)-2H--benzotriazole, and 35 g of 2-(2-hydroxy-3-sec-butyl-5-t-butylphenyl)-2H-benzotriazole as ultraviolet absorbents, 100 g of dodecyl 5-(N,N-diethylamino)-2-benzenesulfonyl-2,4-pentadienoate, 200 ml of tricresyl phosphate, 200 ml of ethyl acetate, 20 g of sodium dodecylbenzenesulfonate and a 10% aqueous solution of gelatin were stirred at a high speed to obtain an emulsion (hereinafter designated as Emulsion (a)). Emulsion (a) was mixed with a 10% gelatin aqueous solution, black colloidal silver, water and a coating aid, and the resulting coating composition was coated on the base to a dry film thickness of 2 μm.

2nd Layer: (Gelatin Intermediate Layer)

2,5-Di-t-octylhydroquinone was dissolved in 100 ml of dibutyl phthalate and 100 ml of ethyl acetate, and the solution was stirred together with 1 Kg of a 10% gelatin aqueous solution at a high speed to obtain an emulsion (hereinafter designated as Emulsion (b)). Two kilograms of Emulsion (b) was mixed with 1.5 Kg of a 10% gelatin aqueous solution, and the resulting coating composition was coated to a dry film thickness of 1 μm.

3rd Layer: (Low Sensitive Red-Sensitive Emulsion Layer)

In 100 ml of tricresyl phosphate and 100 ml of ethyl acetate was dissolved 100 g of a cyan coupler, 2-(heptafluorobutylamido)-5-[2'-(2",4"-di-t-aminophenoxy)- butylamido]-phenol, and the solution was stirred together with 1 Kg of a 20% gelatin aqueous solution at a high speed to obtain an emulsion (hereinafter designated as Emulsion (c)). Emulsion (c) (500 g) was mixed with 1 Kg of a red-sensitive silver iodobromide emulsion (silver content: 70 g; gelatin content: 60 g; iodide content: 4 mol %), and the resultant coating composition was coated to a dry film thickness of 1 μm which corresponds to a silver coverage of 0.5 g/m$^2$.

4th Layer: (High Sensitive Red-Sensitive Emulsion Layer)

Emulsion (c) was mixed with 1 Kg of a red-sensitive silver iodobromide emulsion (silver content: 70 g; gelatin content: 60 g; iodide content: 2.5 mol %), and the resulting coating composition was coated to a dry film thickness of 2.5 μm which corresponds to a silver coverage of 0.8 g/m$^2$.

5th Layer: (Intermediate Layer)

Emulsion (b) (1 Kg) was mixed with 1 Kg of a 10% aqueous gelatin solution, and the resulting coating composition was coated to a dry film thickness of 1 μm.

6th Layer: (Low Sensitive Green-Sensitive Emulsion Layer)

An emulsion was prepared in the same manner as for Emulsion (c) for the 3rd layer but using a magenta coupler, 1-(2,4,6-trichlorophenyl)-3-[3-(2,4-di-t-amylphenoxyacetamido)benzamido]-5-pyrazolone, in place of the cyan coupler and using trioctyl phosphate in place of tricresyl phosphate (hereinafter designated as Emulsion (d)). Emulsion (d) (300 g) was mixed with 1 Kg of a green-sensitive silver iodobromide emulsion (silver content: 70 g; gelatin content: 60 g; iodide content: 3 mol %), and the resulting coating composition was coated to a dry film thickness of 2.0 μm which corresponds to a silver coverage of 0.7 g/m$^2$.

7th Layer (High Sensitive Green-Sensitive Emulsion Layer)

Emulsion (d) (1,000 g) was mixed with 1 Kg of a green-sensitive silver iodobromide emulsion (silver content: 70 g; gelatin content: 60 g; iodide content: 2.5 mol %), and the resulting coating composition was coated to a dry film thickness of 2.0 μm which corresponds to a silver coverage of 0.7 g/m$^2$.

8th Layer: (Gelatin Intermediate Layer)

Emulsion (b) (1 Kg) was mixed with 1 Kg of a 10% aqueous gelatin solution, and the composition was coated to a dry film thickness of 0.5 μm.

9th Layer: (Yellow Filter Layer)

An emulsion containing yellow colloidal silver was coated to a dry film thickness of 1 μm.

10th Layer: (Low Sensitive Blue-Sensitive Emulsion Layer)

An emulsion was prepared in the same manner as for Emulsion (c) for the 3rd layer but using a yellow coupler, α-(pivaloyl)-α-(1-benzyl-5-ethoxy-3-hydantoinyl)-2-chloro-5-dodecyloxycarbonylacetanilide, in place of the cyan coupler (hereinafter designated as Emulsion (e)). Emulsion (e) (1,000 g) was mixed with 1 Kg of a blue-sensitive silver iodobromide emulsion (silver content: 70 g; gelatin content: 60 g; iodide content: 2.5 mol %), and the composition was coated to a dry film thickness of 1.5 μm which corresponds to a silver coverage of 0.6 g/m$^2$.

11th Layer: (High Sensitive Blue-Sensitive Emulsion Layer)

Emulsion (e) (1,000 g) was mixed with 1 Kg of a blue-sensitive silver iodobromide emulsion (silver content: 70 g; gelatin content: 60 g; iodide content: 2.5 mol %), and the composition was coated to a dry film thickness of 3 μm, which corresponds to a silver coverage of 1.1 g/m$^2$.

12th Layer: (Second Protective Layer)

Emulsion (a) was mixed with a 10% aqueous gelatin solution, water and a coating aid, and the composition was coated to a dry film thickness of 2 μm.

13th Layer: (First Protective Layer)

A 10% aqueous gelatin solution containing a fine grain emulsion having the grain surface fogged (grain size: 0.06 μm; 1 mol % silver iodobromide emulsion) was coated to a dry film thickness of 0.8 μm which corresponded to a silver coverage of 0.1 g/m$^2$.

Each of these layers contained 1,4-bis(vinylsulfonylacetamido)ethane as a gelatin hardener and a surface active agent in addition to the above-described components.

Sample 42 was prepared in the same manner as Sample 41, except for using the following 6th layer (low sensitive green-sensitive layer) and 7th layer (high sensitive green-sensitive layer), in which Magenta Coupler M-4 was used.

6th Layer: (Low Sensitive Green-Sensitive Layer)

An emulsion prepared in the same manner as for Emulsion (c) for the 3rd layer but using Magenta Coupler M-4 (hereinafter designated as Emulsion (f)) was mixed with 500 g of a green-sensitive silver iodobromide emulsion (silver content: 35 g; gelatin content: 30 g; iodide content: 3 mol %), and the composition was coated to a dry film thickness of 2.0 μm which corresponds to a silver coverage of 0.35 g/m$^2$.

7th Layer: (High Sensitive Green-Sensitive Layer)

Emulsion (d) and an equimoler amount of Emulsion (f) were mixed with 500 g of a green-sensitive silver iodobromide emulsion (silver content: 35 g; gelatin content: 30 g; iodide content: 2.5 mol %), and the composition was coated to a dry film thickness of 2.0 μm which corresponds to a silver coverage of 0.35 g/m$^2$.

Sample 43 was prepared in the same manner as for Sample 42, but Emulsion (f) of the 6th and 7th layers was replaced with an emulsion prepared in the same manner as Emulsion (c) for the 3rd layer, except that Magenta Coupler M-4 and Solvent P-19 of the present invention were used.

Each of Samples 41 to 43 was wedgewise exposed to light in a usual manner, and the exposed sample was subjected to development processing according to the following procedure using the following processing solutions:

| Development Processing Procedure: | | |
|---|---|---|
| First Development | 38° C. | 6 minutes |
| Washing | 38° C. | 2 minutes |
| Reversal | 38° C. | 2 minutes |
| Color Development | 38° C. | 6 minutes |
| Compensation | 38° C. | 2 minuts |
| Bleach | 38° C. | 6 minutes |
| Fixation | 38° C. | 4 minutes |
| Washing | 38° C. | 4 minutes |
| Stabilization | room temperature | 1 minute |
| Drying | | |

| First Developer: | |
|---|---|
| Water | 700 ml |
| Pentasodium nitrilo-N,N,N—trimethylenephosphonate | 2 g |
| Sodium sulfite | 20 g |
| Hydroquinone monosulfonate | 30 g |
| Sodium carbonate monohydrate | 30 g |

-continued

| | |
|---|---|
| 1-Phenyl-4-methyl-4-hydroxy-methyl-3-pyrazolidone | 2 g |
| Potassium bromide | 2.5 g |
| Potassium thiocyanate | 1.2 g |
| Potassium iodide (0.1% solution) | 2 ml |
| Water to make | 1,000 ml |
| Reversing Bath: | |
| Water | 700 ml |
| Pentasodium nitrilo-N,N,N—trimethylenephosphonate | 3 g |
| Stannous chloride dihydrate | 1 g |
| p-Aminophenol | 0.1 g |
| Sodium hydroxide | 8 g |
| Glacial acetic acid | 15 ml |
| Water to make | 1,000 ml |
| Color Development solution | |
| Water | 700 ml |
| Pentasodium nitrilo-N,N,N—trimethylenephosphonate | 3 g |
| Sodium sulfite | 7 g |
| Sodium tertiary phosphate dodecahydrate | 36 g |
| Potassium bromide | 1 g |
| Potassium iodide (0.1% solution) | 90 ml |
| Sodium hydroxide | 3 g |
| Citrazinic acid | 1.5 g |
| N—Ethyl-N—(β-methanesulfonamide-ethyl)-3-methyl-4-aminoaniline sulfate | 11 g |
| 3,6-Dithiaoctane-1,8-diol | 1 g |
| Water to make | 1,000 ml |
| Compensating Solution: | |
| Water | 700 ml |
| Sodium sulfite | 12 g |
| Sodium ethylenediaminetetra-acetate dihydrate | 8 g |
| Thioglycerin | 0.4 ml |
| Glacial acetic acid | 3 ml |
| Water to make | 1,000 ml |
| Bleaching Solution: | |
| Water | 800 ml |
| Sodium ethylenediaminetetra-acetate dihydrate | 2 g |
| Ammonium (ethylenediaminetetra-acetato)iron (III) dihydrate | 120 g |
| Potassium bromide | 100 g |
| Water to make | 1,000 ml |
| Fixing Solution: | |
| Water | 800 ml |
| Sodium thiosulfate | 80.0 g |
| Sodium sulfite | 5.0 g |
| Sodium bisulfite | 5.0 g |
| Water to make | 1,000 ml |
| Stabilizing Solution: | |
| Water | 800 ml |
| Formalin (37 wt %) | 5.0 ml |
| Fuji Dry Well (a trade name for a surface active agent comprising ethylenoxide type nonion produced by Fuji Photo Film Co., Ltd.) | 5.0 ml |
| Water to make | 1,000 ml |

The thus processed samples were evaluated for photographic characteristics. The density measurements were carried out by the use of Standard Densitometer, FSD-103 manufactured by Fuji Photo Film Co., Ltd. The results obtained are shown in Table 5 below.

TABLE 5

| Sample No. | Silver Coverage ($g/m^2$) | Maximum Density | Dye Image Stability: Percent Remaining* (%) | Dye Image Stability: Stain** |
|---|---|---|---|---|
| 41 (Comparison) | 5.0 | 3.03 | 89 | 0.16 |
| 42 (Comparison) | 4.6 | 3.24 | 93 | 0.09 |
| 43 (Invention) | 4.5 | 3.41 | 97 | 0.05 |

Note:
*: Percent of remaining magenta density after irradiation with xenon light of 10,000 lx for 4 days.
**:(Yellow stain density after preservation at 60° C., 70% RH for 6 weeks) - (Yellow stain density immediately after the development).

As is shown in the results of Table 5, Sample 43 in which the coupler of the invention and the high-boiling organic solvent of the invention are used exhibits satisfactory color density, which demonstrates the possibility of reducing the amount of silver used with the present invention. Sample 43 is also excellent in dye image stability and also free from stain formation and is, therefore, greatly advantageous as print material. Further, the magenta dye image of Sample 43 has a distinct hue of high saturation.

EXAMPLE 6

To 9.88 g of Magenta Coupler M-6 of the present invention were added 19.8 g of a high boiling point organic Solvent P-8 and 30 ml of ethyl acetate as an auxiliary solvent, followed by heating to form solution. The solution thus formed was added to 100 ml of an aqueous solution containing 20 g of gelatin and 1.5 g of sodium dodecylbenzenesulfonate, and the mixture was mechanically dispersed in a homoblender to obtain a fine dispersion. The whole quantity of the dispersion was added to 100 g of a silver chlorobromide emulsion (silver content: 6.55 g/Kg-Em, bromide content: 80 mol % Gelatin content: 80 g/Kg-Em), and 42 ml of 2% 2,4-dihydroxy-6-chloro-s-triazine sodium salt was added thereto as a hardener. The resulting coating composition was coated on a paper support having laminated on both side thereof with polyethylene to silver coverage of 190 $mg/m^2$. An aqueous gelatin solution containing 150 ml of the 2% aqueous solution per 100 g of gelatin, was further coated as a protective layer so that a thickness of the film might be 1 μm to form sample. This sample was designated as Sample 101.

Samples 102 and 103 were prepared in the same manner as described above, except that the high boiling point organic Solvent P-8 was replaced with Solvents P-36 and P-30 respectively.

Samples 104, 105 and 106 were prepared using 14.10 g of a coupler M-37 in place of the coupler M-6 in Sample 101, and 28.2 g each of the solvents P-8, P-36 and P-30 as used in Samples 101, 102 and 103 respectively as an high boiling point organic solvent, in the same manner as of the Sample 101.

Further, comparative Samples 107 to 117 were prepared in the same manner as of Sample 101 except that using comparative couplers or comparative high boiling point organic solvent as shown in Table A below.

TABLE A

| Sample No. | Coupler | | High boiling point organic solvent | | Remark |
|---|---|---|---|---|---|
| 101 | M-6 | 9.88 g | P-8 | 19.8 g | |
| 102 | " | " | P-36 | " | |

TABLE A-continued

| | | | | | |
|---|---|---|---|---|---|
| 103 | " | " | P-30 | " | Invention |
| 104 | M-37 | 14.10 g | P-8 | 28.2 g | |
| 105 | " | " | P-36 | " | |
| 106 | " | " | P-30 | " | |
| 107 | M-6 | 9.88 g | Comparative high boiling point organic solvent *4 | 19.8 g | Comparison |
| 108 | M-37 | 14.10 g | Comparative high boiling point organic solvent *4 | 28.2 g | |
| 109 | Comparative Coupler *1 | 7.44 g | P-8 | 14.9 g | Comparison |
| 110 | Comparative Coupler *1 | " | P-36 | " | |
| 111 | Comparative Coupler *2 | 7.87 g | P-8 | 15.7 g | |
| 112 | Comparative Coupler *2 | " | P-36 | " | |
| 113 | Comparative Coupler *3 | 5.25 g | P-8 | 10.5 g | |
| 114 | Comparative Coupler *3 | " | P-36 | " | |
| 115 | Comparative Coupler *1 | 7.44 g | Comparative high boiling point organic solvent *4 | 14.9 g | Comparison |
| 116 | Comparative Coupler *2 | 7.87 g | Comparative high boiling point organic solvent *4 | 15.7 g | |
| 117 | Comparative Coupler *3 | 5.25 g | Comparative high boiling point organic solvent *4 | 10.5 g | |

*1 Comparative coupler
Coupler (17) disclosed in SSP 4,540,654

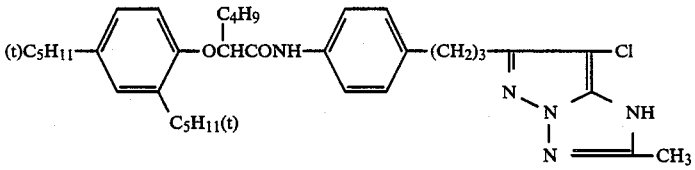

*2 Comparative coupler
Coupler (8) disclosed in U.S. Pat. No. 4,659,652

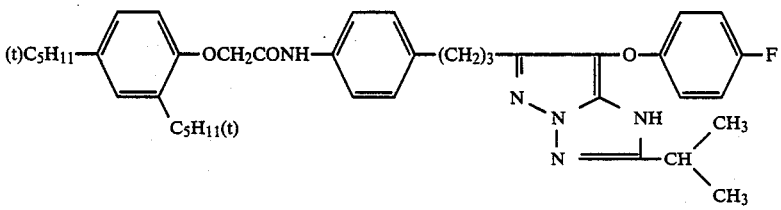

*3 Comparative coupler
Coupler (18) disclosed in U.S. Pat. No. 4,500,630

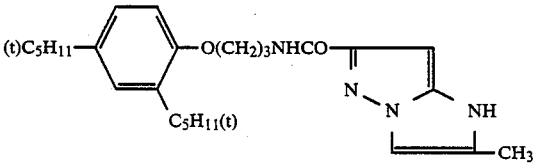

*4 Comparative high boiling point solvent

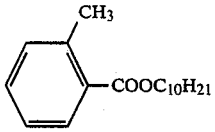

| | |
|---|---|
| Dielectric constant | 3.61 |
| Viscosity | 7.9 |

Each of Samples, thus obtained, were wedgewise exposed to light at 1,000 CMS, and the exposed Sample was processed under the condition set forth below.

| | Temperature | Time |
|---|---|---|
| Color development | 33° C. | 3 minutes 30 seconds |
| Bleach fixing | 33° C. | 1 minutes 30 seconds |
| Water washing | 28 to 35° C. | 3 minutes |

Color development solution

-continued

| (pH 10.1) | (I) | (II) |
|---|---|---|
| Benzyl alcohol | 15 ml | 15 ml |
| Diethylenetriamine-pantaacetic acid | 5 g | 5 g |
| KBr | 0.4 g | 0.4 g |
| $Na_2SO_3$ | 5 g | 2.5 g |
| $Na_2CO_3$ | 30 g | 30 g |
| Hydroxylamine sulfate | 2 g | 2 g |
| 4-Amino-3-methyl-N—β-(methanesulfonamido) ethylaniline 3/2 $H_2SO_4.H_2O$ | 4.5 g | 4.5 g |
| **Bleach fixing bath (pH 6.8)** | | |
| Ammonium thiosulfate (70 wt %) | 150 m | |
| $Na_2SO_3$ | 5 g | |
| Na[Fe(EDTA)] | 40 g | |
| EDTA | 4 g | |
| Water to make | 1,000 ml | |

The thus processed samples were evaluated for photographic characteristics in the same manner as in Example 1, and the results obtained are shown in Table B below. In Table B, the sensitivity of Sample 101 was taken as 100 (standard).

mercially processed at various loboratories. The present invention is able to dismiss possible troubles such that when an exhaust rate of the color development solution in each laboratories will be different and a concentration of $Na_2SO_3$ is varied, a balance of a sensitivity, gradation and color density between three color layers each other is not maintained to remarkably impair a value of the photographic images due to the differences of the sensitivity and color gradation at a shoulder. Thus, the present invention is believed to be excellent in producing a stable color images without any chwbacks, even when na exhaust rate of the color development solution and a concentration of $Na_2SO_3$ will be varied.

BACKGROUND FOR EXAMPLES 7 AND 8

The basic procedure used in EXAMPLES 7 and 8 is set out below. Modifications are explained in EXAMPLE 7 and EXAMPLE 8 as set out below. Modifications are explained in EXAMPLE 7 and EXAMPLE 8 with reference to BACKGROUND.

Sample I was prepared in the same manner as Sample A in BACKGROUND, but Coupler M-40 was replaced with 17.2 g. of Coupler M-28, Solvent P-36 was replaced with 22.2 g. of Solvent P-40 and the support was cellulose triacetale. Sample J was prepared per Sample I but Solvent P-40 was replaced with Comparative Compound B as used in Example 1.

Each of Samples I and J was exposed to light at the same exposure as in Example 1 and processed in the same manner as in Example 1. The results of measurements of photographic characteristics are shown in Table 8. In Table 8, the relative sensitivity was expressed taking the sensitivity of Sample I as (100).

TABLE B

| Sample No. | Coupler | High boiling point organic solvent | Fog (I) | Fog (II) | Relative sensitivity *5 (I) | Relative sensitivity *5 (II) | Dens. of Shoulder *6 (I) | Dens. of Shoulder *6 (II) | Remark |
|---|---|---|---|---|---|---|---|---|---|
| 101 | M-6 | P-8 | 0.09 | 0.09 | 100 | 101 | 2.42 | 2.45 | Invention |
| 102 | " | P-36 | 0.09 | 0.09 | 110 | 112 | 2.48 | 2.52 | |
| 103 | " | P-30 | 0.09 | 0.09 | 101 | 102 | 2.44 | 2.47 | |
| 104 | M-37 | P-8 | 0.10 | 0.10 | 105 | 106 | 2.51 | 2.54 | |
| 105 | " | P-36 | 0.10 | 0.10 | 116 | 117 | 2.59 | 2.63 | |
| 106 | " | P-30 | 0.10 | 0.10 | 107 | 108 | 2.56 | 2.60 | |
| 107 | M-6 | Comparative high boiling point organic solvent *4 | 0.09 | 0.09 | 93 | 98 | 2.30 | 2.43 | Comparison |
| 108 | M-37 | Comparative high boiling point organic solvent *4 | 0.09 | 0.09 | 97 | 104 | 2.41 | 2.55 | |
| 109 | Comparative Coupler *1 | P-8 | 0.09 | 0.09 | 90 | 95 | 2.24 | 2.33 | Comparison |
| 110 | Comparative Coupler *1 | P-36 | 0.09 | 0.09 | 91 | 96 | 2.27 | 2.37 | |
| 111 | Comparative Coupler *2 | P-8 | 0.12 | 0.13 | 104 | 111 | 2.46 | 2.52 | |
| 112 | Comparative Coupler *2 | P-36 | 0.13 | 0.14 | 113 | 121 | 2.53 | 2.59 | |
| 113 | Comparative Coupler *3 | P-8 | 0.09 | 0.09 | 86 | 92 | 2.02 | 2.19 | |
| 114 | Comparative Coupler *3 | P-36 | 0.09 | 0.09 | 88 | 95 | 2.11 | 2.30 | |
| 115 | Comparative Coupler *1 | Comparative high boiling point organic solvent *4 | 0.09 | 0.09 | 82 | 89 | 1.93 | 2.21 | Comparison |
| 116 | Comparative Coupler *2 | Comparative high boiling point organic solvent *4 | 0.09 | 0.09 | 93 | 103 | 2.32 | 2.50 | |
| 117 | Comparative Coupler *3 | Comparative high boiling point organic solvent *4 | 0.09 | 0.09 | 75 | 83 | 1.77 | 1.98 | |

*5, *6: As disclosed in Example 1
*1–*4: As disclosed in the foot note of Table A It can be seen from Table B above that a combination of the coupler and the high boiling point organic solvent according to the present invention exhibits little variety on the photographic charcateristics, particularly in a sensitivity and gradation in color density at shoulder, comparing with of the comparative couplers and comparative high boiling point organic solvents (having low dielectric constant and low viscosity).

Moreover, these excellent results can be evaluated, for example, when the photographic material is com-

TABLE 8

| Sample No. | Coupler | High-Boiling Organic Solvent | Photographic Characteristics: Fog | Relative Sensitivity | Density at Shoulder | Gamma |
|---|---|---|---|---|---|---|
| E | M-27 | P-40 | 0.05 | 100 | 3.63 | 3.96 |
| F | " | Comparative Compound B | 0.06 | 90 | 3.02 | 3.67 |
| G | M-41 | P-40 | 0.04 | 100 | 3.57 | 3.79 |

TABLE 8-continued

| Sample No. | Coupler | High-Boiling Organic Solvent | Photographic Characteristics: Fog | Relative Sensitivity | Density at Shoulder | Gamma |
|---|---|---|---|---|---|---|
| H | " | Comparative Compound B | 0.05 | 82 | 2.90 | 3.30 |
| I | M-28 | P-40 | 0.04 | 100 | 3.55 | 3.71 |
| J | " | Comparative Compound B | 0.05 | 84 | 2.81 | 3.22 |
| K | M-29 | P-40 | 0.05 | 100 | 3.95 | 4.12 |
| L | " | Comparative Compound B | 0.09 | 93 | 3.56 | 3.78 |

The above results prove that the combined use of the coupler and high-boiling organic solvent according to the present invention exhibits superior performances in sensitivity, gradient, density at the shoulder and freedom from fog.

EXAMPLE 8

A coating composition was prepared in the same manner as described in BACKGROUND, but using 9.0 g of Coupler M-32, 18.0 g of Solvent O-36 and 30 ml of ethyl acetate.

A coating composition was prepared in the same manner as in BACKGROUND, but using 9.2 g of Coupler M-34, 18.4 g of Solvent P-36 and 30 ml of ethyl acetate.

A coating composition was prepared in the same manner as in BACKGROUND, but using Comparative Coupler A as used in Example 1 and 20 g of di-2-ethylhexyl phthalate.

Using each of these coating compositions, color photographic light-sensitive materials (Samples M, N and O) were prepared by coating a paper support having polyethylene laminated on both sides thereof with the following 1st layer (the bottom layer) to the 7th layer (top layer). In the sample preparation, the coating composition for each emulsion layer was prepared in accordance with the process described in Example 6.

| | |
|---|---|
| 7th Layer: | |
| Gelatin | 1600 mg/m$^2$ |
| 6th Layer: | |
| Gelatin | 1000 mg/m$^2$ |
| Ultraviolet absorbent*1 | 360 mg/m$^2$ |
| Solvent*2 | 120 mg/m$^2$ |
| 5th Layer: | |
| Silver chlorobromide emulsion (bromide content: 50 mol %) | 300 mg-Ag/m$^2$ |
| Gelatin | 1200 mg/m$^2$ |
| Cyan coupler*3 | 400 mg/m$^2$ |
| Solvent*2 | 250 mg/m$^2$ |
| 4th Layer: | |
| Gelatin | 1600 mg/m$^2$ |
| Ultraviolet absorbent*1 | 700 mg/m$^2$ |
| Color mixing preventing agent*4 | 200 mg/m$^2$ |
| Solvent*2 | 300 mg/m$^2$ |
| 3rd Layer: | |
| Silver chlorobromide emulsion (bromide content: 50 mol %) | 180 mg-Ag/m$^2$ |
| Magenta coupler*5 | |
| Solvent*6 | 550 mg/m$^2$ |
| 2nd Layer: | |
| Gelatin | 1100 mg/m$^2$ |
| Color mixing preventing agent*4 | 200 mg/m$^2$ |
| Solvent*2 | 100 mg/m$^2$ |
| 1st Layer: | |
| Silver chlorobromide emulsion (bromide content: 80 mol %) | 350 mg-Ag/m$^2$ |

-continued

| | |
|---|---|
| Gelatin | 1500 mg/m$^2$ |
| Yellow coupler*7 | 500 mg/m$^2$ |
| Solvent*8 | 400 mg/m$^2$ |

Note:
*1 2-(2-Hydroxy-3-sec-butyl-5-t-butylphenyl)-benzotriazole
*2 Dibutyl phthalate
*3 2-[α-(2,4-di-t-pentylphenoxy)butaneamido]-4,6-dichloro-5-methylphenol
*4 2,5-Dioctylhydroquinone
*5 Coupler (M-32), Coupler (M-34) or Comparative Coupler A (as described above)
*6 Solvent P-36 or di-2-ethylhexyl phthalate (as described above)
*7 α-Pivaloyl-α-(2,4-dioxo-5,5-dimethyloxa-zolidin-3-yl)-2-chloro-5-[α-2,4-di-t-pentylphenoxy)butaneamido]acetanilide
*8 Dioctylbutyl phosphate Each of Samples M to O was exposed to light through separation filters B, G and R and processed in the same manner as in Example 1.

As a result, the dye images of Samples M and N using Couplers M-32 and M-34, respectively, showed high sensitivities, higher densities at the shoulder, higher gradients, lower fog densities and more distinct hue with higher saturation as compared with the dye image of Sample O.

As described above, the present invention makes it possible to obtain silver halide photographic light-sensitive materials having improved development activity with the use of pyrazoloazole magenta couplers. Further, the present invention makes it possible to obtain silver halide color photographic light-sensitive materials which form a magenta dye image of an excellent hue with a sharp drop in absorption at the bottom in the long wavelength side and which have improved color reproducibility and dye image stability.

In particular, use of the high-boiling organic solvents having a viscosity of 50 cps or more (at 25° C.) provides silver halide color photographic light-sensitive materials exhibiting excellent photographic characteristics in sensitivity, gradient and density at the shoulder.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon at least one silver halide emulsion layer, wherein at least one magenta coupler represented by the formula (VIII):

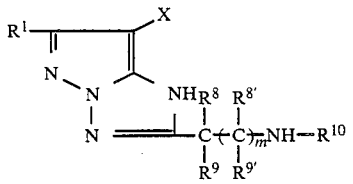

(VIII)

wherein $R^1$ represents a hydrogen atom, a halogen atom, a substituted or unsubstituted alkyl group, a substituted or unsubstituted aryl group, a substituted or unsubstituted heterocyclic group, a cyano group, a substituted or unsubstituted alkoxy group, a substituted or unsubstituted aryloxy group, a substituted or unsubstituted heterocyclic oxy group, a substituted or unsubstituted acyloxy group, a substituted or unsubstituted carbamoyloxy group, a substituted or unsubstituted silyloxy group, a substituted or unsubstituted sulfonyloxy group, a substituted or unsubstituted acylamino group, a substituted or unsubstituted anilino group, a substituted or unsubstituted ureido group, a substituted or unsubstituted imido group, a substituted or unsubstituted sulfamoylamino group, a substituted or unsubstituted carbamoylamino grou, a substituted or unsubstituted alkylthio group, a substituted or unsubstituted arylthio group, a substituted or unsubstituted heterocyclic thio group, a substituted or unsubstituted alkoxycarbonylamino group, a substituted or unsubstituted aryloxycarbonylamino group, a substituted or substituted sulfonamido group, a substituted or unsubstituted carbamoyl group, a substituted or unsubstituted acyl group, a substituted or unsubstituted sulfamoyl group, a substituted or unsubstituted sulfonyl group, a substituted or unsubstituted sulfinyl group, a substituted or unsubstituted alkoxycarbonyl group or a substituted or unsubstituted arylkoxycarbonyl group; and X represents a hydrogen atom or a group releasable by coupling with an oxidized product of an aromatic primary amine developing agent, $R^8$, $R^{8'}$, $R^9$ and $R^{9'}$ each represents a hydrogen atom, a cyano group, a halogen atom, a substituted or unsubstituted alkyl group, a substituted or unsubstituted aryl group, a substituted or unsubstituted heterocyclic group, a substituted or unsubstituted alkoxy group, a substituted or unsubstituted aryloxy group, a substituted or unsubstituted acylamino group, a substituted or unsubstituted alkylthio group, a substituted or unsubstituted arylthio group, a substituted or unsubstituted sulfonamido group, a substituted or substituted carbamoyl group, a substituted or unsubstituted sulfamoyl group or a substituted or unsubstituted sulfonyl group, with proviso that $R^8$, $R^{8'}$, $R^9$ and $R^{9'}$ do not simultaneously take the same atom or group unless otherwise represents the hydrogen atom, the cyano group, the halogen atom and the substituted or unsubstituted alkyl group; m represents 0 or an integer of from 1 to 5; and $R^{10}$ represents a substituted or unsubstituted acyl group, a substituted or unsubstituted sulfonyl group, a substituted or unsubstituted alkoxycarbonyl group, a substituted or unsubstituted carbamoyl group or a substituted or unsubstituted sulfamoyl group, is dispersed in the silver halide emulsion layer in the presence of at least one high-boiling organic solvent represented by one of the formulae (II), (III), (IV) and (V):

$$R^3—COOR^4 \quad \text{(II)}$$

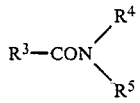

(III)

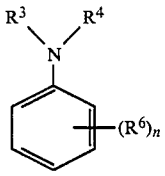

(IV)

$$R^3—O—R^4 \quad \text{(V)}$$

wherein $R^3$, $R^4$ and $R^5$ each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $R^6$ represents $R^3$, $—OR^3$ or $—SR^3$ is as defined above; n represents an integer of from 1 to 5; when n is 2 or more each $R^6$ may be the same or different; $R^3$ and $R^4$ in the formula (V) may together form an oxirane ring, an oxorane ring or an oxane ring, which may be substituted or form a fused ring; and the high boiling point organic solvent has a dielectric constant of not less than 4.00 at 25° C. and 10 KHz.

2. A silver halide color photographic light-sensitive material as in claim 1, wherein $R^1$, $R^{10}$ or X is a divalent group to form a bis compound or a polymer.

3. A silver halide color photographic light-sensitive material as in claim 1, wherein said polymer is a homopolymer derived from a monomer having an ethylenically unsaturated group represented by the formula (VIII) or a copolymer derived from said monomer and non-color-forming ethylenically unsaturated monomer.

4. A silver halide color photographic light-sensitive material as in claim 1, wherein said high-boiling organic solvents have a dielectric constant of not less than 5.00 at 25° C. and 10 KHz and a viscosity of not less than 20 cps at 25° C.

5. A silver halide color photogrpahic light-sensitive material as in claim 4, wherein said high-boiling organic solvents have a viscosity of not less than 50 cps at 25° C.

6. A silver halide color photographic light-sensitive material as in claim 1, wherein a weight proportion of said high-boiling organic solvent to said magenta coupler is from 0.05 to 20.

7. A silver photographic emulsion as claimed in claim 1, wherein when X represents a group releasable by coupling with an oxidized product of an aromatic primary amine developing agent, the group X is selected from a halogen atom and group which is bonded to the carbon atom at the coupling position via a sulfur atom.

* * * * *